US009696658B2

(12) United States Patent
Yamaguchi et al.

(10) Patent No.: US 9,696,658 B2
(45) Date of Patent: Jul. 4, 2017

(54) DEVELOPER CONTAINER, DEVELOPING APPARATUS, PROCESS CARTRIDGE, AND IMAGE FORMING APPARATUS

(71) Applicant: CANON KABUSHIKI KAISHA, Tokyo (JP)

(72) Inventors: Seiji Yamaguchi, Mishima (JP); Hiroki Ogino, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/077,611

(22) Filed: Mar. 22, 2016

(65) Prior Publication Data

US 2016/0282762 A1 Sep. 29, 2016

(30) Foreign Application Priority Data

Mar. 27, 2015 (JP) ..... 2015-065552

(51) Int. Cl.
*G03G 15/08* (2006.01)

(52) U.S. Cl.
CPC ..... *G03G 15/0889* (2013.01); *G03G 15/0891* (2013.01); *G03G 2215/0852* (2013.01)

(58) Field of Classification Search
CPC ..... G03G 15/0887; G03G 15/0891; G03G 15/0896; G03G 2215/0802; G03G 2215/0852; G03G 2221/163; G03G 15/0889
USPC ..... 399/261, 281
See application file for complete search history.

(56) References Cited

U.S. PATENT DOCUMENTS 7,899,369 B2 * 3/2011 Kurogawa ..... G03G 15/0877 399/261 X
8,064,806 B2 * 11/2011 Nishiwaki ..... G03G 15/0887 399/261 X
8,081,909 B2 * 12/2011 Nishiwaki ..... G03G 15/0887 399/261
8,874,010 B2 * 10/2014 Wada ..... 399/261 X
2007/0286645 A1 * 12/2007 Hayashi ..... G03G 15/0875 399/262

(Continued)

FOREIGN PATENT DOCUMENTS

JP 59-227618 A 12/1984
JP 04178671 A 6/1992
JP 2002-196585 A 7/2002

*Primary Examiner* — Sophia S Chen
(74) *Attorney, Agent, or Firm* — Canon USA, Inc. I.P. Division

(57) ABSTRACT

A developer container, which includes an opening and is configured to store developer therein, includes a developer conveyance plate configured to convey the developer. The developer conveyance plate includes a vibration target unit configured to receive a vibration, and conveys the developer in a first direction in which the developer is conveyed toward an opening side, and in a second direction perpendicular to the first direction. The developer is conveyed by the vibration transmitted from the vibration target unit with use of a resultant force generated by adding a conveyance component in the first direction and a conveyance component in the second direction. A maximum acceleration a1 (max) in the first direction that is provided to the developer conveyance plate by the vibration transmitted from the vibration target unit is set to a lower acceleration than a maximum acceleration a2 (max) in an opposite direction from the first direction.

14 Claims, 9 Drawing Sheets

(56) References Cited

U.S. PATENT DOCUMENTS

| | | | | |
|---|---|---|---|---|
| 2009/0129822 | A1 | 5/2009 | Toh et al. | |
| 2012/0163876 | A1 | 6/2012 | Wada | |
| 2014/0219688 | A1* | 8/2014 | Murata | G03G 15/0877 399/261 X |
| 2016/0097993 | A1* | 4/2016 | Shinohara | 399/261 X |

* cited by examiner

DEVELOPER CONTAINER, DEVELOPING APPARATUS, PROCESS CARTRIDGE, AND IMAGE FORMING APPARATUS

BACKGROUND OF THE INVENTION

Field of the Invention

The present invention relates to a developer container, a developing apparatus, a process cartridge, and an image forming apparatus. Examples of the image forming apparatus include an electrophotographic copying machine that forms an image on a recording medium with use of an electrophotographic image forming method. Further, the examples of the image forming apparatus include an electrophotographic printer, such as a laser beam printer and a light-emitting diode (LED) printer, and a facsimile apparatus.

Description of the Related Art

Conventionally, there has been disclosed a configuration including, inside a developer container detachably mounted within an image forming apparatus, a stirring conveyance member configured to convey contained developer toward a developing roller while stirring the developer, such as a configuration discussed in Japanese Patent Application Laid-Open No. 2002-196585. The configuration discussed in this patent literature uses a plurality of stirring conveyance members.

Further, there has been disclosed a powdery/granular material conveyance apparatus including a swingably supported bearing member for a powdery/granular material and a vibration generator for providing a vibration to this bearing member, and configured to convey the powdery/granular material borne on the bearing member by vibrating this bearing member, such as an apparatus discussed in Japanese Patent Application Laid-Open No. 59-227618.

However, according to the configuration discussed in Japanese Patent Application Laid-Open No. 2002-196585, the stirring conveyance member conveys only the developer located within a radius of a rotation. Therefore, a bottom surface of a storage container should be formed so as to have an arc-like shape in cross-section. For example, a protruding portion is formed on a floor surface of the storage container that the stirring conveyance member cannot reach, so that the developer is prevented from being accumulated on a region where this protruding portion is formed. This protruding portion becomes a dead space, thereby leading to a reduction in a volume that accommodates the developer.

SUMMARY OF THE INVENTION

The present invention has been contrived to solve the above-described problem, and is directed to a developer container capable of reducing a dead space in a path along which the developer is conveyed, and reducing unevenness in a direction perpendicular to a direction in which the developer is conveyed.

According to an aspect of the present invention, a developer container, which includes an opening and is configured to store developer therein, includes a conveyance member configured to convey the developer. The conveyance member includes a vibration target unit configured to receive a vibration, and conveys the developer in a first direction in which the developer is conveyed toward an opening side where the opening is located, and in a second direction perpendicular to this first direction. The developer is conveyed by the vibration transmitted from the vibration target unit with use of a resultant force generated by adding a conveyance component in the first direction and a conveyance component in the second direction. A maximum acceleration in the first direction that is provided to the conveyance member by the vibration transmitted from the vibration target unit is set to a lower acceleration than a maximum acceleration in an opposite direction from the first direction that is provided by the vibration transmitted from the vibration target unit.

Further features of the present invention will become apparent from the following description of exemplary embodiments with reference to the attached drawings.

DESCRIPTION OF THE EMBODIMENTS

One exemplary embodiment of an image forming apparatus on which a process cartridge including a developing apparatus equipped with a developer container according to each of exemplary embodiments of the present invention is detachably mounted will be specifically described with reference to the drawings. However, the present invention does not necessarily have to be limited to dimensions, materials, shapes, a relative layout, and the like of component parts that will be described in each of the following exemplary embodiments. Further, in the following description, a longitudinal direction of the process cartridge is an axial direction of an image bearing member. Further, a left and a right respectively mean a left and a right, in a direction in which the recording medium is conveyed, when a recording medium is viewed from above.

Further, an upper surface and a lower surface of the process cartridge mean a surface located on an upper side and a surface located on a lower side with the process cartridge mounted on a main body of the image forming apparatus, respectively. Further, a developer conveyance direction is a direction that is horizontal and is the longitudinal direction of the process cartridge, and a direction that is horizontal and perpendicular to this longitudinal direction. Further, a direction moving toward a developer bearing member (a forward direction) is a developer conveyance direction J1 (a first direction), and a direction moving away from the developer bearing member (a backward direction) is a developer conveyance opposite direction J2 (an opposite direction from the first direction).

FIGS. 1 to 4 relate to a first exemplary embodiment of the image forming apparatus on which the process cartridge including the developing apparatus equipped with the developer container according to one of the exemplary embodiments of the present invention is detachably mounted. First, a configuration of this first exemplary embodiment will be described with reference to FIGS. 1 to 4.

<Image Forming Apparatus>

Figure 1:
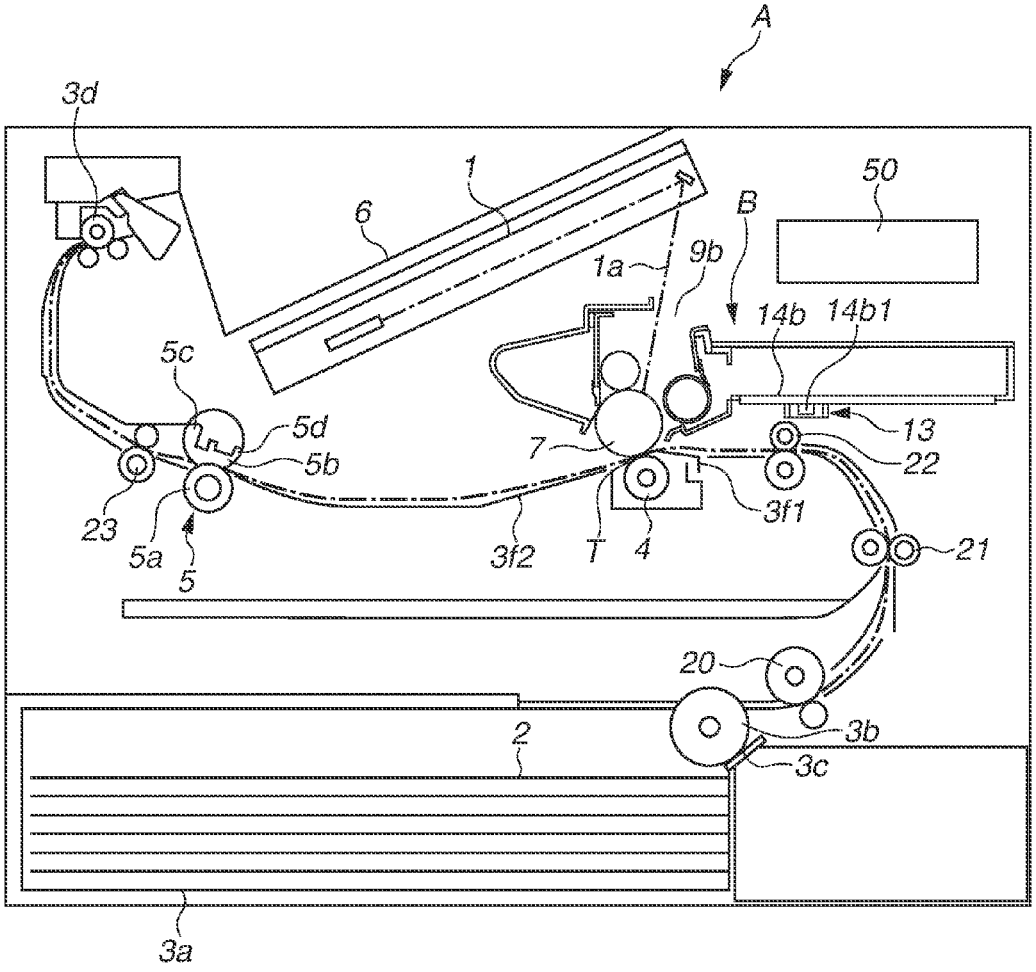
FIG. 1 is an illustrative cross-sectional view illustrating a configuration of an image forming apparatus on which a process cartridge including a developing apparatus equipped with a developer container according to an exemplary embodiment of the present invention is detachably mounted.

An overall configuration of an electrophotographic image forming apparatus 100 will be described now with reference to FIG. 1. FIG. 1 is an illustrative cross-sectional view illustrating a configuration of the image forming apparatus 100 on which a process cartridge B according to the first exemplary embodiment is mounted. The image forming apparatus 100 according to the present exemplary embodiment is an example in which the present invention is applied to a laser beam printer.

As illustrated in FIG. 1, the image forming apparatus 100 includes the process cartridge B detachably mounted on a main body A of this image forming apparatus 100. A photosensitive drum 7, which serves as an image bearing member, is disposed in the process cartridge B.

Figure 2:
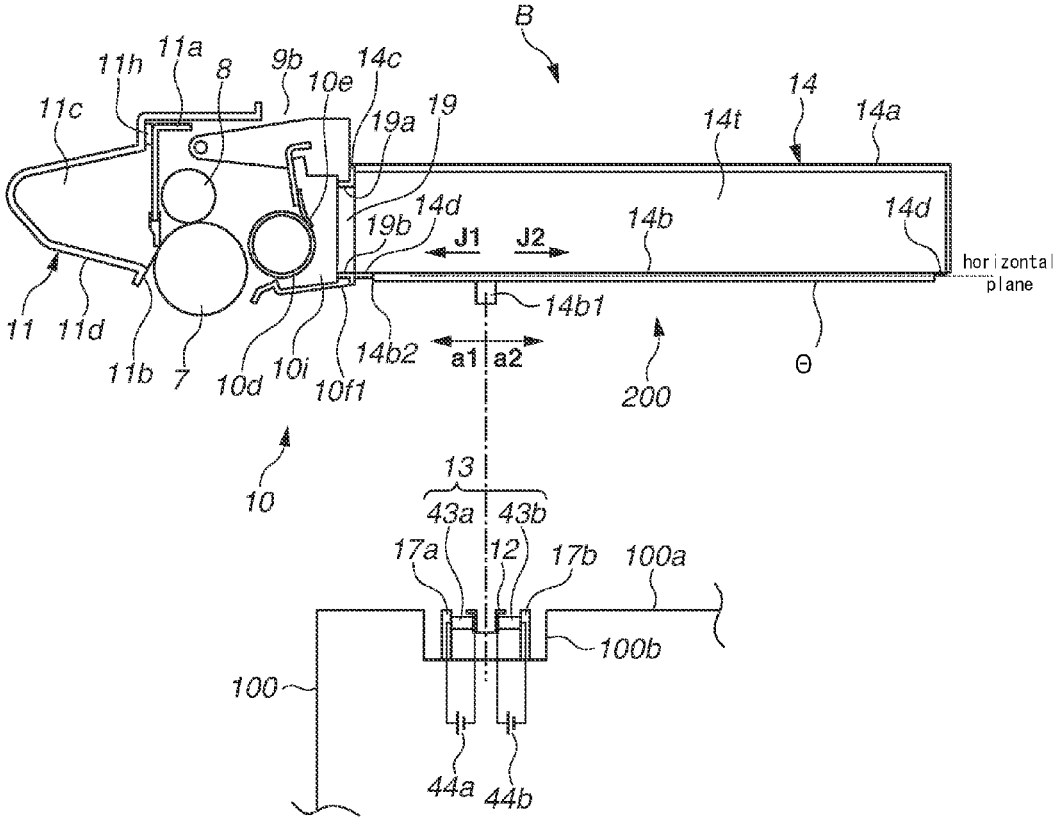
FIG. 2 is an illustrative cross-sectional view illustrating a configuration of a first exemplary embodiment of the process cartridge including the developing apparatus equipped with the developer container according to the exemplary embodiment of the present invention and the image forming apparatus on which this process cartridge is to be mounted.

Further, the image forming apparatus 100 emits, from a laser scanner which serves as an image exposure unit, laser light 1*a* based on image information onto a surface of the photosensitive drum 7 evenly charged by a charging roller 8 illustrated in FIG. 2, which serves as a charging unit, to scan and expose this surface with and to the laser light 1*a*. As a result, an electrostatic latent image is formed on the surface of the photosensitive drum 7.

After that, application of a developing bias voltage to the developing roller 10*d* illustrated in FIG. 2, which serves as the developer bearing member, causes toner borne on a surface of this developing roller 10*d*, which is used as developer, to be supplied to the electrostatic latent image formed on the surface of the photosensitive drum 7 to develop the electrostatic latent image, thereby forming a toner image.

On the other hand, recording media 2 are fed from a sheet cassette 3*a* illustrated in FIG. 1 by a pickup roller 3*b* in synchronization with the operation of forming the toner image onto the surface of the photosensitive drum 7. Examples usable as the recording medium 2 include paper, an overhead transparency (OHT) sheet used together with an overhead projector (OHP) and made of a transparent sheet, and a fabric. Then, the recording media 2 are separated and fed one by one by collaboration between the pickup roller 3*b* and a separation member 3*c* disposed in pressure contact with this pickup roller 3*b*.

After being separated and fed one by one by the collaboration between the pickup roller 3*b* and the separation member 3*c*, the recording media 2 are sequentially conveyed by conveyance rollers 20 and 21, and a leading edge of each of the recording media 2 runs into a registration roller 22 that is temporarily static. Then, firmness of a material of this recording medium 2 allows the leading edge of this recording medium 2 to be brought into abutment along a nip portion of the registration rollers 22, which contributes to a correction of a skew.

After that, the recording medium 2 is conveyed while being sandwiched by the registration rollers 22 in such a manner that a position thereof matches the toner image formed on the surface of the photosensitive drum 7. Then, this recording medium 2 is conveyed along a conveyance guide 3*f*1 to a transfer nip portion T, where the photosensitive drum 7 disposed in the process cartridge B and a transfer roller 4 serving as a transfer unit are located opposite from each other.

Then, a transfer bias voltage is applied to the transfer roller 4, by which the toner image formed on the surface of the photosensitive drum 7 is transferred onto the recording medium 2 conveyed to the transfer nip portion T. The recording medium 2 with the toner image transferred thereon is conveyed along a conveyance guide 3*f*2 to a fixing device 5, which serves as a fixing unit.

The fixing device 5 includes a driving roller 5*a*, and a fixing rotational member 5*d* constructed with use of a cylindrical sheet containing a heater 5*b* therein and rotatably supported by a support member 5*c*. Then, the fixing device 5 applies heat and a pressure onto the recording medium 2 passing through a fixing nip portion between the fixing rotational member 5*d* and the driving roller 5*a*, by which the toner image is fixed onto this recording medium 2 by being heated.

The recording medium 2 with the toner image fixed thereon by being heated by the fixing device 5 is conveyed to a discharge roller 3*d* by a conveyance roller 23. The discharge roller 3*d* discharges the recording medium 2 with the toner image fixed thereon to a discharge unit 6. The image forming apparatus 100 forms an image onto the recording medium 2 with use of the developer (the toner) in this manner.

A controller 50 illustrated in FIG. 1, which serves as a control unit, controls driving of various kinds of devices disposed within the main body of the image forming apparatus 100. The controller 50 according to the present exemplary embodiment controls driving of a vibration providing member 13, which will be described in detail below.

<Process Cartridge>

Next, a configuration of the process cartridge B will be described with reference to FIG. 2. FIG. 2 is an illustrative cross-sectional view illustrating the configuration of the process cartridge B. As illustrated in FIG. 2, the process cartridge B according to the present exemplary embodiment includes the photosensitive drum 7 as the image bearing member that bears the toner image (a developer image), and at least one image forming process unit.

The at least one image forming process unit includes the charging roller 8, which serves as the charging unit that charges the surface of the photosensitive drum 7, and the developing unit 10, which serves as the developing unit that develops the electrostatic latent image formed on the surface of the photosensitive drum 7. Further, the at least one image forming process units include, for example, a cleaning blade 11*a*, which serves as a cleaning unit that cleans the surface of the photosensitive drum 7 by removing the tonner remaining on the surface of the photosensitive drum 7 after the toner image is transferred therefrom.

A drum unit 11 illustrated in FIG. 2 includes a drum frame 11*d*, which rotatably supports the photosensitive drum 7. Further, the cleaning blade 11*a* is disposed in the drum frame 11*d*. Further, the charging roller 8 is rotatably disposed in the drum frame 11*d*. Further, a removed tonner storage unit 11*c* and a gathering sheet 11*b* are provided in the drum frame 11*d*.

The developing unit 10 includes a developing frame 10*f*1, which rotatably supports the developing roller 10*d*. A developing chamber 10*i* is formed in the developing frame 10*f*1.

A developer container 14, which contains the toner to be used as the developer, includes a frame member 14*a*, and a developer conveyance plate 14*b*, which serves as a plate-shaped conveyance member where the toner to be used as the developer is placed and conveyed. The frame member 14*a* and the developer conveyance plate 14*b* form an outer shell of the developer container 14. Further, the developer conveyance plate 14*b*, which serves as the conveyance member, includes a vibration target unit 14*b*1, which receives driving (a vibration) for conveying the toner to be used as the developer and then transmits the driving (the vibration) to this developer conveyance plate 14*b*. The vibration target unit 14*b*1 is located below the developer conveyance plate 14*b*.

The developer container 14 further includes an opening member 14*c*, which has an opening 19 for discharging the toner to be used as the developer from this developer container 14. Further, the developer container 14 includes a flexible coupling member 14*d*, which couples the frame member 14*a*, the opening member 14*c*, and the developer conveyance plate 14*b* with one another. The flexible coupling member 14*d* is disposed across an entire circumference of the developer conveyance plate 14*b*. The coupling member 14*d* extends/compresses, or swings when the developer conveyance plate 14*b* serving as the conveyance member conveys the developer toward the opening 19 side (an opening side).

A developer storage unit (a storage unit) 14*t*, where the developer is stored, is formed by the developer conveyance plate 14*b* serving as the conveyance member, the coupling member 14*d*, the opening member 14*c*, and the frame member 14*a*. As understood from FIG. 2, the developer conveyance plate 14*b*, which serves as the conveyance member, forms a bottom of the developer storage unit 14*t*. Therefore, a member for forming the bottom does not need to be prepared additionally. The developer conveyance plate 14*b*, which serves as the conveyance member, is disposed on a lower side (a lower end side) where a lower end 19*b* of the opening 19 is located. The opening 19 includes an upper end 19*a*.

The developer container 14 stores the developer (the toner) in the developer storage unit 14*t*. The developer container 14 is connected to the developing unit 10 by the opening member 14*c* coupled with the developing unit 10, and the developing chamber 10*i* of the developing unit 10 and the developer storage unit 14*t* of the developer container 14 are in communication with each other via the opening 19 of the opening member 14*c*. The process cartridge B according to the present exemplary embodiment includes the drum unit 11, the developing unit 10, and the developer container 14.

<Image Forming Process>

Next, an image forming process by the process cartridge B will be described with reference to FIGS. 1 and 2. Referring to FIG. 2, first, the photosensitive drum 7 having a photosensitive layer is rotated, and a charging bias voltage is applied to the charging roller 8 serving as the charging unit, by which the surface of the photosensitive drum 7 is evenly charged.

After that, the evenly charged surface of the photosensitive drum 7 is scanned with and exposed to the laser light 1*a* based on the image information that is emitted from the laser scanner 1 illustrated in FIG. 1 via an exposure opening 9*b* provided at the drum frame 11*d* of the process cartridge B. As a result, the electrostatic latent image is formed on the surface of this photosensitive drum 7.

After that, the developing bias voltage is applied to the developing roller 10*d* disposed in the developing unit 10 (the developing apparatus), by which the developer (the toner) borne on the surface of this developing roller 10*d* is supplied to the electrostatic latent image formed on the surface of the photosensitive drum 7. As a result, the electrostatic latent image formed on the surface of the photosensitive drum 7 is developed to be visualized into a visible image as the toner image.

The developing unit 10 rotatably supports the developing roller 10*d* as the developer bearing member that bears the developer. In the present exemplary embodiment, as illustrated in FIG. 2, the developer conveyance plate 14*b* serving as the conveyance member, the coupling member 14*d*, the opening 19, and the developing roller 10*d* serving as the developer bearing member are arranged in this order from an upstream side to a downstream side in the developer conveyance direction J1 (from a right side to a left side in FIG. 2).

A toner layer provided with a charge from frictional electrification by a developing blade 10*e* together with the rotation of the developing roller 10*d* is formed on the surface of this developing roller 10*d*. The toner borne on the surface of the developing roller 10*d* is transferred to the electrostatic latent image on the surface of the photosensitive drum 7, by which the toner image is formed onto the surface of the photosensitive drum to visualize the electrostatic latent image into the visible image.

After that, the transfer bias voltage, which has an opposite polarity from a polarity of the toner image on the surface of the photosensitive drum 7, is applied to the transfer roller 4 illustrated in FIG. 1. By this application, the toner image on the surface of the photosensitive drum 7 is transferred onto the recording medium 2. The toner remaining on the surface of the photosensitive drum 7 after the toner image is transferred onto the recording medium 2 is swept off by the cleaning blade 11*a* serving as the cleaning unit fixed to the drum frame 11*d* by a fixation unit 11*h* illustrated in FIG. 2.

Further, the toner is gathered up by the gathering sheet 11*b* to be collected into the removed toner storage unit 11*c*.

<Developer Conveyance Device>

Figure 3A:
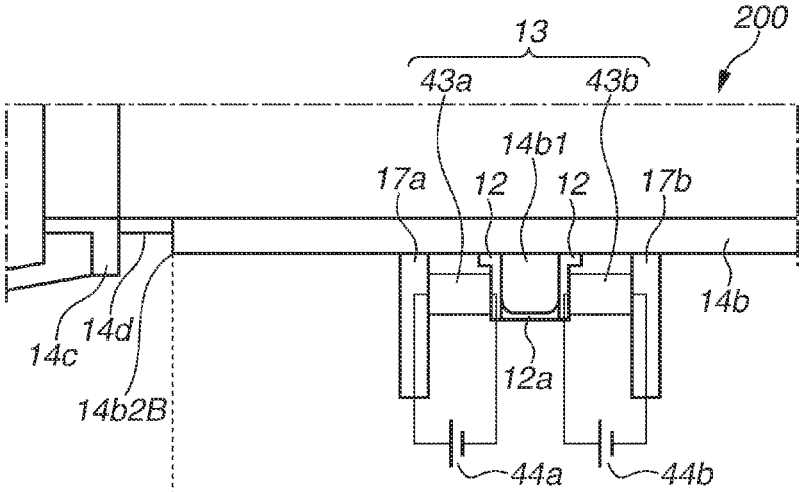
FIGS. 3A, 3B, and 3C are partial cross-sectional views illustrating how a conveyance member of the developer container according to the first exemplary embodiment is vibrated to thereby convey developer.
Figure 3B:
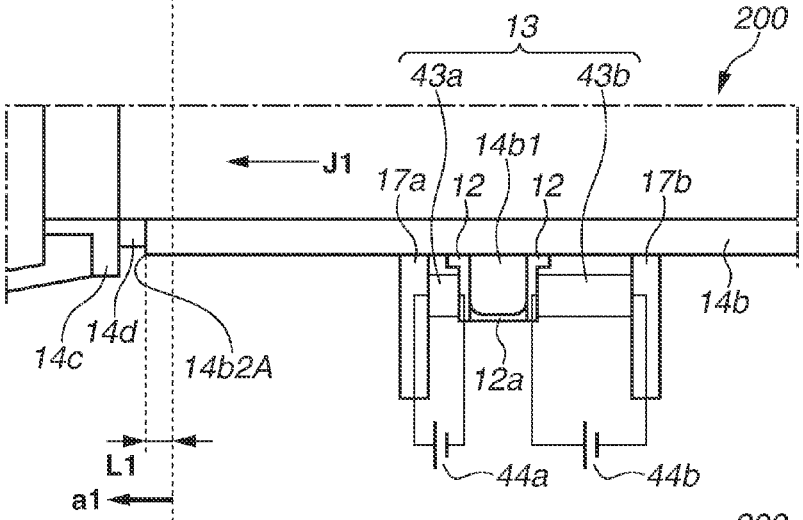
Figure 3C:
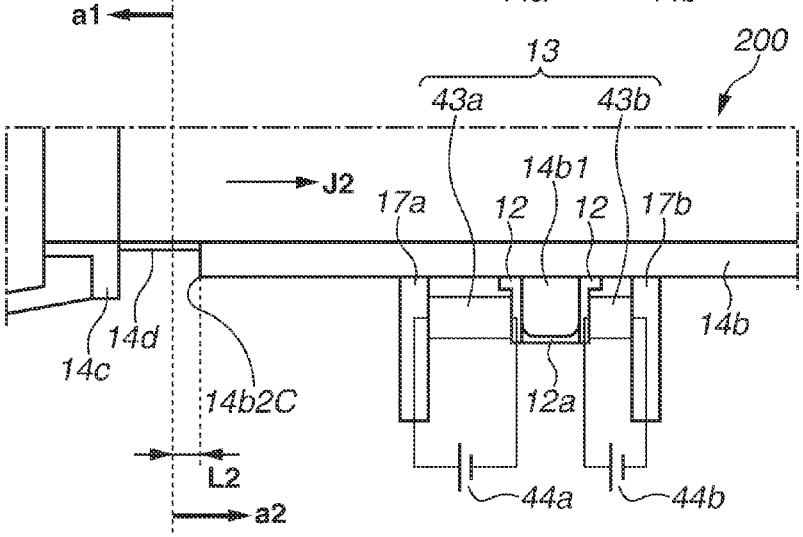
Figure 4:
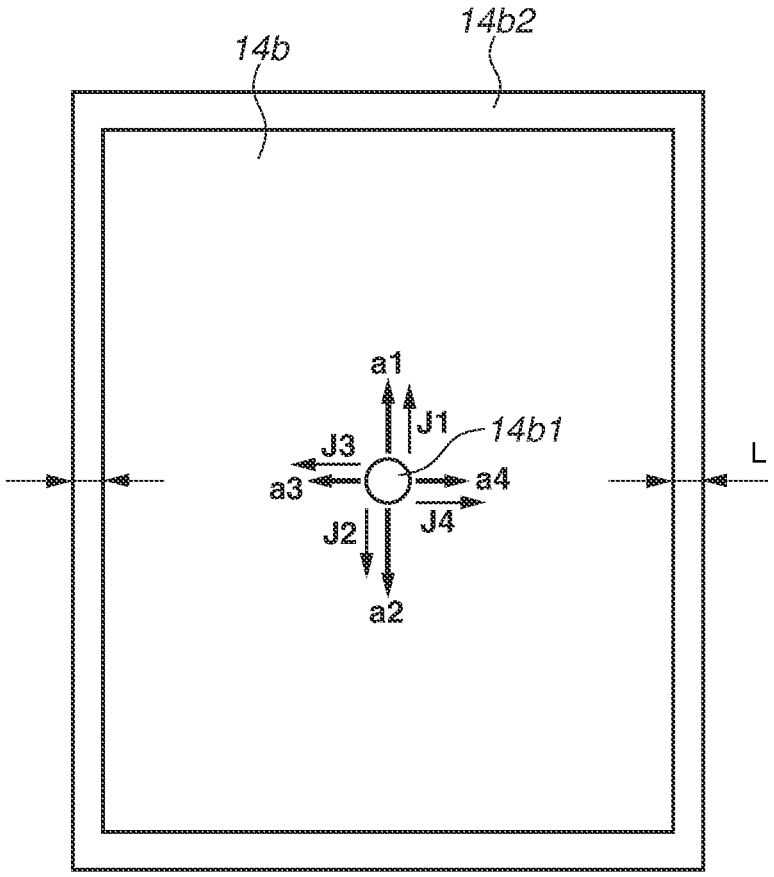
FIG. 4 is an illustrative plan view illustrating a developer conveyance direction in which the developer is conveyed when the conveyance member of the developer container according to the first exemplary embodiment is vibrated.

Next, a configuration of a developer conveyance device 200 will be described with reference to FIGS. 1 to 4. FIG. 2 is an illustrative cross-sectional view illustrating the configuration of the developer conveyance device 200. FIGS. 3A to 3C are partial cross-sectional views of FIG. 2. FIG. 4 is an illustrative plan view illustrating the developer conveyance plate 14*b* of the developer conveyance device 200 as viewed from above. As illustrated in FIG. 2, the developer conveyance device 200 includes the developer container 14. The developer container 14 includes the frame member 14*a*, the developer conveyance plate 14*b*, the opening member 14*c*, and the coupling member 14*d*.

Further, the developer conveyance device 200 includes the vibration target unit 14*b*1 disposed under a lower surface of the developer conveyance plate 14*b* in a protruding manner. An acceleration a1 is provided to the vibration target unit 14*b*1 relative to this developer conveyance plate 14*b* along the developer conveyance direction J1 (the first direction) illustrated in FIGS. 2 and 3B. Further, an acceleration a2 is provided to the vibration target unit 14*b*1 relative to this developer conveyance plate 14*b* along the developer conveyance opposite direction J2 illustrated in FIG. 3C, which is the opposite direction from the first direction. The accelerations a1 and a2 are accelerations of a reciprocating motion.

Further, accelerations a3 and a4 of a reciprocating motion are respectively provided to the vibration target unit 14*b*1 relative to this developer conveyance plate 14*b* along directions J3 and J4 (a second direction) perpendicular to the developer conveyance direction J1 as illustrated in FIG. 4.

As a result, in the present exemplary embodiment, an acceleration a5 is also provided in a direction J5 that is a combination of the developer conveyance direction J1 (the first direction) and the direction J3 (the second direction) perpendicular to this developer conveyance direction J1 (the first direction), as will be described below with reference to FIG. 8A. Further, an acceleration a6 is provided in a direction J6 that is a combination of the developer conveyance direction J1 (the first direction) and the direction J4 (the second direction) perpendicular to this developer conveyance direction J1 (the first direction), as illustrated in FIG. 8B. These accelerations a5 and a6 are alternately repeatedly provided.

Due to this configuration, vibrations of first and second piezoelectric elements, which vibrate in directions perpendicular to each other, are transmitted to the developer conveyance plate 14*b* via the vibration target unit 14*b*1. These vibrations cause the developer to be conveyed with use of a resultant force generated by adding a conveyance component in the developer conveyance direction J1 (the first direction) and a conveyance component in the direction J3 (the second direction) perpendicular to this developer conveyance direction J1 and a resultant force generated by adding the conveyance component in the developer conveyance direction J1 (the first direction) and a conveyance component in the direction J4 (the second direction) perpendicular to this developer conveyance direction J1.

This vibration target unit 14*b*1 is detachably fitted in a recessed portion of the vibration providing member 13, which is constructed with use of the piezoelectric elements. The vibration providing member 13, which is constructed with use of the piezoelectric elements, vibrates along each of the following directions.

The vibration providing member 13 vibrates this vibration target unit 14*b*1 along the developer conveyance direction J1 (the first direction) and the developer conveyance opposite direction J2 (the opposite direction from the first direction). Further, the vibration providing member 13 vibrates the vibration target unit 14*b*1 along each of the directions J3 and J4 (the second direction) perpendicular to the developer conveyance direction J1.

Direct-current power sources 44*a* and 44*b* illustrated in FIGS. 3A to 3C are controlled by the controller 50, which serves as the control unit. The following voltages are applied to electrodes disposed on respective both ends of a pair of piezoelectric elements 43*a* and 43*b*, which are configured as the vibration providing member 13. The controller 50 turns on and off these direct-current power sources 44*a* and 44*b* at predetermined timings to thereby cause the voltages to be applied to the electrodes. Then, the piezoelectric elements 43*a* and 43*b* are mechanically deformed according to a frequency of this switching.

This deformation causes the vibration providing member 13, which is constructed with use of the pair of piezoelectric elements 43*a* and 43*b*, to vibrate. This vibration is transmitted to the vibration target unit 14*b*1. As a result, this vibration target unit 14*b*1 is vibrated along the developer conveyance direction J1 illustrated in FIGS. 2 and 3B. Further, the vibration target unit 14*b*1 is vibrated along the developer conveyance opposite direction J2 illustrated in FIG. 3C. Further, the vibration target unit 14*b*1 is vibrated along each of the directions J3 and J4 perpendicular to the developer conveyance direction J1, which are illustrated in FIG. 4. An electrostrictive vibrator or a magnetostrictive vibrator can be used as each of the piezoelectric elements 43*a* and 43*b*.

In the present exemplary embodiment, the vibration providing member 13 includes the first piezoelectric elements 43*a* and 43*b* illustrated in FIGS. 2 and 3A to 3C, which vibrate in the developer conveyance direction J1 illustrated in FIGS. 2 and 3B and the developer conveyance opposite direction J2 illustrated in FIG. 3C. Further, the vibration providing member 13 includes the not-illustrated second piezoelectric elements, which vibrate in the directions J3 and J4 perpendicular to the developer conveyance direction J1, which are illustrated in FIG. 4.

As illustrated in FIG. 2, a reception unit 100*a*, on which the process cartridge B is to be mounted, is prepared on the main body side of the image forming apparatus 100. A recessed portion 100*b*, in which the vibration providing member 13 is disposed, is formed at this reception unit 100*a*. Support units 17*a* and 17*b* are erected in the recessed portion 100*b*. One ends of the pair of piezoelectric elements 43*a* and 43*b* are fixed to both sides of a holder unit 12, and the other ends of the pair of piezoelectric elements 43*a* and 43*b* are fixed to these support units 17*a* and 17*b*, respectively.

When the process cartridge B illustrated in FIG. 2 is mounted on the reception unit 100*a* prepared at the main body of the image forming apparatus 100, the process cartridge including the developer conveyance device 200 is positioned in the following manner. As illustrated in FIGS. 3A to 3C, the vibration target unit 14*b*1, which is disposed under the lower surface of the developer conveyance plate 14*b* in the protruding manner, is fitted in a recessed portion 12*a* of the holder unit 12.

In the present exemplary embodiment, the developer conveyance device 200 is configured to vibrate the vibration target unit 14*b*1 using the pair of piezoelectric elements 43*a* and 43*b*, which is disposed, via the holder unit 12, on both sides of this vibration target unit 14*b*1 protruding under the lower surface of the developer conveyance plate 14*b*, along the developer conveyance direction J1 illustrated in FIG. 2.

As illustrated in FIGS. 3A to 3C, the vibration target unit 14*b*1, which protrudes under the lower surface of the developer conveyance plate 14*b*, is set up in the following manner. The vibration target unit 14*b*1 is fitted in the recessed portion 12*a* of the holder unit 12, which is disposed at the vibration providing member 13 mounted on the main body side of the image forming apparatus 100 so as to be reciprocatable in the developer conveyance direction J1 illustrated in FIG. 3B and the developer conveyance opposite direction J2 illustrated in FIG. 3C.

The individual direct-current power sources 44*a* and 44*b* are electrically connected to the electrodes disposed on the both end surfaces of the individual piezoelectric elements 43*a* and 43*b*, respectively. Then, the direct-current voltages are applied from the individual direct-current power sources 44*a* and 44*b* to the both end surfaces of the individual piezoelectric elements 43*a* and 43*b*, respectively, while being turned on/off at the predetermined timings by the controller 50 illustrated in FIG. 1, which serves as the control unit.

The individual piezoelectric elements 43*a* and 43*b* are made of elastic members (piezoelectric elements) that extend by the application of the direct-current voltages from the individual direct-current power sources 44*a* and 44*b*, respectively, and compress into original sizes by a stop of the application of the direct-current voltages. The direct-current voltages applied from the individual direct-current power sources 44*a* and 44*b* to the individual piezoelectric elements 43*a* and 43*b*, respectively, and the timings of this application are appropriately controlled. This control can generate an acceleration difference (a1<a2) between the acceleration a1, at which the developer conveyance plate 14*b* is displaced in the developer conveyance direction J1 (a forward path) illustrated in FIG. 3B, and the acceleration a2, at which the developer conveyance plate 14*b* is displaced in the developer conveyance opposite direction J2 (a backward path) illustrated in FIG. 3C.

For example, suppose that the direct-current voltage to be applied to each of the piezoelectric elements 43*a* and 43*b* is set to approximately 500 V, and is set to have a square waveform at a frequency of approximately 60 Hz as a voltage waveform thereof. The direct-current voltage to be applied from the direct-current power source 44*a* to the piezoelectric element 43*a* is set to a higher voltage than the direct-current voltage to be applied from the direct-current power source 44*b* to the piezoelectric element 43*b*. This setting can generate the acceleration difference (a1<a2) between the acceleration a1, at which the developer conveyance plate 14*b* is displaced in the developer conveyance direction J1, and the acceleration a2, at which the developer conveyance plate 14*b* is displaced in the developer conveyance opposite direction J2.

Further, the not-illustrated second piezoelectric elements configured to vibrate in the directions J3 and J4 perpendicular to the developer conveyance direction J1, which are illustrated in FIG. 4, and direct-current power sources therefor are also configured in a similar manner.

The direction in which the developer (the toner) placed on the developer conveyance plate 14*b* (on the conveyance member) is conveyed is the developer conveyance direction J1 from the developer storage unit 14*t* toward the developing chamber 10*i* illustrated in FIG. 2 (the direction from the right side to the left side in FIG. 2), which corresponds to the first direction.

The opening 19, which is used to supply the developer (the toner) stored in the developer storage unit 14*t* of the developer container 14 toward the developing roller 10*d* along the developer conveyance direction J1 illustrated in FIG. 2, is formed at the opening member 14*c*.

As illustrated in FIG. 1, the developer conveyance device 200 is set in such a manner that the developer conveyance plate 14*b*, which forms the bottom surface of the developer container 14, is substantially horizontally arranged with the process cartridge B mounted on the main body of the image forming apparatus 100.

<Conveyance Member>

Next, a configuration of the developer conveyance plate 14*b*, which serves as the plate-shaped conveyance member, will be described. The developer conveyance plate 14*b* is the plate-shaped member disposed below the developer (the toner) and used to convey the developer (the toner). The developer conveyance plate 14*b* forms the bottom surface of the developer container 14. Further, the vibration target unit 14*b*1, to which the vibration of the vibration providing member 13 is transmitted, is disposed under the lower surface of the developer conveyance plate 14*b* in the protruding manner. A polystyrene (PS) having a thickness of approximately 1.5 mm is used as a material of the developer conveyance plate 14*b* according to the present exemplary embodiment.

<Coupling Member>

Further, as illustrated in FIG. 2, the developer storage unit 14*t*, which serves as a storage unit where the developer is stored, is formed by the developer conveyance plate 14*b* serving as the conveyance member, the flexible coupling member 14*d*, the opening member 14*c*, and the frame member 14*a* of the developer container 14. The entire circumference of the developer conveyance plate 14*b* is swingably supported by the flexible coupling member 14*d*. Due to this configuration, the developer conveyance plate 14*b* is connected swingably along the developer conveyance direction J1, the developer conveyance opposite direction J2, and the directions J3 and J4 (the second direction) perpendicular to the developer conveyance direction J1. A flexible silicon rubber having a thickness of approximately 300 μm is used as a material of the coupling member 14*d* according to the present exemplary embodiment.

<Function of Conveying Developer>

Next, a function of conveying the developer by the developer conveyance device 200 will be described. In the present exemplary embodiment, the vibration providing member 13, which is constructed with use of the pair of piezoelectric elements 43*a* and 43*b* and the like, is disposed on the main body side of the image forming apparatus 100. As illustrated in FIGS. 2 and 3A to 3C, the developer conveyance device 200 functions in the following manner with the process cartridge B mounted on the main body of the image forming apparatus 100. The vibration target unit 14*b*1, which protrudes under the lower surface of the developer conveyance plate 14*b* disposed in the process cartridge B, is fitted in the recessed portion 12*a* of the holder unit 12 of the vibration providing member 13 disposed at the main body of the image forming apparatus 100.

Then, the direct-current power sources 44*a* and 44*b* are controlled by the controller 50. The direct-current voltages are applied from these direct-current power sources 44*a* and 44*b* to the electrodes disposed at the both ends of the piezoelectric elements 43*a* and 43*b*, which are used to construct the vibration providing member 13, at the predetermined timings. This application causes the vibration providing member 13, which is constructed with use of the pair of piezoelectric elements 43*a* and 43*b*, to vibrate at a predetermined frequency, and this vibration of the vibration providing member 13 is transmitted to the developer conveyance plate 14*b* via the vibration target unit 14*b*1.

As a result, the accelerations a1 and a2 of the reciprocating motion are provided to the developer conveyance plate 14*b* along the developer conveyance direction J1 illustrated in FIGS. 2 and 3B and the developer conveyance opposite direction J2 illustrated in FIG. 3C, respectively. Further, the accelerations a3 and a4 of the reciprocating motion are provided to the developer conveyance plate 14*b* along the directions J3 and J4 perpendicular to the developer conveyance direction J1, which are illustrated in FIG. 4, respectively. Then, this developer conveyance plate 14*b* is vibrated along the developer conveyance direction J1, the developer conveyance opposite direction J2, and the directions J3 and J4 perpendicular to the developer conveyance direction J1.

In the present exemplary embodiment, the conveyance of the developer (the toner) is arranged in consideration of a maximum acceleration a1 (max) provided to the developer conveyance plate 14*b* in the developer conveyance direction J1 illustrated in FIGS. 2 and 3B. Then, this maximum acceleration a1 (max) is set so as to be lower than a maximum acceleration a2 (max) provided in the developer conveyance opposite direction J2 illustrated in FIG. 3C. This setting allows the developer (the toner) on the developer conveyance plate 14*b* to be conveyed in the developer conveyance direction J1 illustrated in FIG. 3B.

On the other hand, the accelerations a3 and a4 are provided in such a manner that the reciprocating motion therefrom becomes substantially symmetric, regarding the vibration in the directions J3 and J4 (the longitudinal direction of the developing roller 10*d*) perpendicular to the developer conveyance direction J1, which are illustrated in FIG. 4. This setting allows the developer (the toner) to be evened out in a left-right direction in FIG. 4 (the longitudinal direction of the developing roller 10*d*) without being conveyed only in any specific direction.

The process cartridge B is mounted in the following manner according to an operation of attaching and detaching the process cartridge B to and from the main body of the image forming apparatus 100. The process cartridge B is attached to the recessed portion 12*a* of the holder unit 12 of the vibration providing member 13 disposed on the main body of this image forming apparatus 100 in the following manner. The vibration target unit 14*b*1, which protrudes under the lower surface of the developer conveyance plate 14*b* disposed in the process cartridge B, is detachably and separably fitted in the recessed portion 12*a*.

In the developer conveyance device 200 according to the present exemplary embodiment, the developing frame 10*f*1 of the developing unit 10 and the developer container 14 are integrally coupled with each other via the opening member 14*c*. The developer conveyance plate 14*b*, which forms the bottom surface of the developer container 14, is swingably supported by the flexible coupling member 14*d*. The vibration target unit 14*b*1, which is disposed under the lower surface of this developer conveyance plate 14*b* in the protruding manner, is vibrated by the vibration providing member 13.

The developer conveyance plate 14*b* is vibrated by being provided with the acceleration a1 in the developer conveyance direction J1 illustrated in FIGS. 2 and 3B. Further, the developer conveyance plate 14*b* is vibrated by being provided with the acceleration a2 in the developer conveyance opposite direction illustrated in FIG. 3C. The accelerations a1 and a2 are the accelerations of the reciprocating motion. Further, the developer conveyance plate 14*b* is vibrated by being provided with the accelerations a3 and a4 of the reciprocating motion in the directions J3 and J4 perpendicular to the developer conveyance direction J1, which are illustrated in FIG. 4.

This configuration can improve a volume in the developer storage unit 14*t*, compared to the configuration including the member for conveying the developer (the toner) inside the developer container, such as Japanese Patent Application Laid-Open No. 2002-196585. Further, this configuration can reduce a space necessary for the swinging motion, compared to the configuration that elastically deforms an arm to swing a reception plate, such as Japanese Patent Application Laid-Open No. 59-227618.

<Behavior of Developer in Conveyance Direction During Vibration>

Next, a behavior of the developer (the toner) on the surface of the developer conveyance plate 14*b* in the conveyance direction will be described. First, an operation of the developer conveyance device 200 will be described with reference to FIGS. 3A to 3C. A distal end 14*b*2 of the developer conveyance plate 14*b*, which is illustrated in FIG. 2, reciprocates between the following positions by the vibration of the vibration providing member 13 via the vibration target unit 14*b*1.

The vibration target unit 14*b*1 protruding under the lower surface of the developer conveyance plate 14*b*, which is illustrated in FIG. 3A, is fitted and attached in the recessed portion 12*a* of the holder unit 12 of the vibration providing member 13 kept in a static state. At this time, the coupling member 14*d* is in a natural state in which the coupling member 14*d* is neither extended/compressed nor swung. The distal end 14*b*2 of the developer conveyance plate 14*b* reciprocates from an initial position 14*b*2B at this time to either of the following positions.

The vibration of the vibration providing member 13 causes, via the vibration target unit 14*b*1, the distal end 14*b*2 of the developer conveyance plate 14*b*, which is illustrated in FIG. 2, to be displaced to a maximum displacement position 14*b*2A, where the distal end 14*b*2 is maximally displaced in the developer conveyance direction J1 illustrated in FIG. 3B. At this time, the coupling member 14*d* is in a compressed state. Further, the distal end 14*b*2 of the developer conveyance plate 14*b* is displaced to a maximum displacement position 14*b*2C, where the distal end 14*b*2 is maximally displaced in the developer conveyance opposite direction J2 illustrated in FIG. 3C, which is the opposite direction from the developer conveyance direction J1. At this time, the coupling member 14*d* is in an extended state. The developer conveyance plate 14*b* is configured reciprocatably between these positions. The coupling member 14*d* swings according to the reciprocating displacement of the developer conveyance plate 14*b*, which is illustrated in FIGS. 3A to 3C.

<Setting of Acceleration in Developer Conveyance Direction>

The maximum acceleration a1 (max) in the developer conveyance direction J1 illustrated in FIG. 3B, which is provided from the vibration target unit 14*b*1 with the vibration of the vibration providing member 13 transmitted thereto to the developer conveyance plate 14*b*, is set in the following manner. The maximum acceleration a1 (max) is set to a lower acceleration than the maximum acceleration a2 (max) provided from this vibration target unit 14*b*1 to the developer conveyance plate 14*b* in the developer conveyance opposite direction J2 illustrated in FIG. 3C, which is the opposite direction from the developer conveyance direction J1.

The maximum acceleration a2 (max) of the developer conveyance plate 14*b* vibrated by the vibration providing member 13 in the developer conveyance opposite direction J2 illustrated in FIG. 3C is set in the following manner. The maximum acceleration a2 (max) is set to an acceleration that allows the developer (the toner) on the surface of this developer conveyance plate 14*b* to slide on the surface of this developer conveyance plate 14*b*.

This setting causes the developer (the toner) on the developer conveyance plate 14*b* to slide on the surface of this developer conveyance plate 14*b* due to its own inertia when this developer conveyance plate 14*b* is displaced in the developer conveyance opposite direction J2 illustrated in FIG. 3C. This means that the developer (the toner) on the developer conveyance plate 14*b* is relatively displaced on this developer conveyance plate 14*b* to the left side in FIG. 3C from the point of view of this developer conveyance plate 14*b*.

On the other hand, the maximum acceleration a1 (max), in the developer conveyance direction J1, of the developer conveyance plate 14*b* vibrated by the vibration providing member 13 via the vibration target unit 14*b*1 illustrated in FIG. 3B is set in the following manner. The maximum acceleration a1 (max) is set to a lower acceleration than the maximum acceleration a2 (max) in the developer conveyance opposite direction J2 illustrated in FIG. 3C. In this case, the developer (the toner) on this developer conveyance plate 14*b* is displaced integrally with this developer conveyance plate 14*b* without sliding on the surface of this developer conveyance plate 14*b*.

Repetition of such vibrations causes the developer (the toner) on this developer conveyance plate 14*b* to be conveyed on the surface of this developer conveyance plate 14*b* in the developer conveyance direction J1 illustrated in FIG. 3B.

<Condition for Sliding Motion of Developer>

The developer (the toner) on the surface of the developer conveyance plate 14*b* slides on the surface of this developer conveyance plate 14*b* when a certain condition is satisfied. Next, this condition will be described. The developer (the toner) on the surface of the developer conveyance plate 14*b* slides on the surface of this developer conveyance plate 14*b* under the following condition. Assume that μ0 represents a static friction coefficient between the surface of this developer conveyance plate 14*b* and the developer (the toner), g represents a gravitational acceleration, and {μ0×g} is a product of these static friction coefficient μ0 and gravitational acceleration g.

The developer (the toner) is placed onto the surface of the developer conveyance plate 14*b*. While being kept in this state, this developer conveyance plate 14*b* is driven to reciprocate along the developer conveyance direction J1 illustrated in FIG. 3B by the vibration of the vibration providing member 13 via the vibration target unit 14*b*1. The acceleration a1 at this time is set so as to be higher than the product {μ0×g}.

Alternatively, the acceleration a2, at which the developer conveyance plate 14*b* is driven to reciprocate along the developer conveyance opposite direction J2 illustrated in FIG. 3C, is set so as to be higher than the product {μ0×g}. Alternatively, the accelerations a3 and a4, at which the developer conveyance plate 14*b* is driven to reciprocate along the directions J3 and J4 perpendicular to the developer conveyance direction J1 illustrated in FIG. 4, are set so as to be higher than the product {μ0×g}. This setting causes the developer (the toner) on the surface of the developer conveyance plate 14*b* to slide on the surface of this developer conveyance plate 14*b*.

<Capability to Convey Developer>

Next, consideration is to be made on the maximum acceleration a1 (max), at which this developer conveyance plate 14*b* is displaced by the vibration of the vibration providing member 13 in the developer conveyance direction J1 illustrated in FIG. 3B. Further, consideration is to be made on the maximum acceleration a2 (max), at which this developer conveyance plate 14*b* is displaced by the vibration of the vibration providing member 13 in the developer conveyance opposite direction J2 illustrated in FIG. 3C. Further, consideration is to be made on {μ0×g}, which is the product of the static friction coefficient μ0 between the surface of the developer conveyance plate 14*b* and the developer (the toner) and the gravitational acceleration g. A relationship among them, and a capability to convey the developer (the toner) on the surface of this developer conveyance plate 14*b* will be described now.

<Acceleration Condition Capable of Causing Conveyance of Developer>

Consideration is to be made on the maximum acceleration a1 (max), at which this developer conveyance plate 14*b* is displaced by the vibration of the vibration providing member 13 in the developer conveyance direction J1 illustrated in FIG. 3B. Further, consideration is to be made on the maximum acceleration a2 (max), at which the developer conveyance plate 14*b* is displaced in the developer conveyance opposite direction J2 illustrated in FIG. 3C. Then, the maximum acceleration a1 (max) and the maximum acceleration a2 (max) are in the following relationship with each other. The relationship between the maximum acceleration a1 (max) and the maximum acceleration a2 (max) may be expressed by the following expression, an expression 1, with use of the product {μ0×g} of the static friction coefficient μ0 between the surface of the developer conveyance plate 14*b* and the developer (the toner), and the gravitational acceleration g.

$$\{\mu 0 \times g\} < a1(\max) < a2(\max) \quad \text{[Expression 1]}$$

If the maximum accelerations a1 (max) and a2 (max) are in the relationship expressed by the above-described expression 1, the developer conveyance plate 14*b* is displaced at the maximum acceleration a1 (max) by the vibration of the vibration providing member 13 in the developer conveyance direction J1 illustrated in FIG. 3B. Further, the developer conveyance plate 14*b* is displaced at the maximum acceleration a2 (max) in the developer conveyance opposite direction J2 illustrated in FIG. 3C. At this time, the developer conveyance plate 14*b* is displaced in the developer conveyance opposite direction J2 illustrated in FIG. 3C. In such a case, the developer (the toner) sliding on the surface of this developer conveyance plate 14*b* is relatively displaced on the surface of this developer conveyance plate 14*b* in the developer conveyance direction J1 illustrated in FIG. 3B.

In other words, the developer (the toner) on the surface of the developer conveyance plate 14*b* is displaced on the surface of the developer conveyance plate 14*b* in both the developer conveyance direction J1 illustrated in FIG. 3B and the developer conveyance opposite direction J2 illustrated in FIG. 3C. In this case, the maximum accelerations a1 (max) and a2 (max) are set so as to satisfy {a1 (max)<a2 (max)} as indicated in the above-described expression 1.

Therefore, seen from the developer conveyance plate 14*b*, the developer (the toner) is relatively displaced by the following distance (a distance by which the developer (the toner) slides on the surface of the developer conveyance plate 14*b*). The developer (the toner) is relatively displaced by a longer distance when the developer conveyance plate 14*b* is displaced in the developer conveyance opposite direction J2 illustrated in FIG. 3C, compared to when this developer conveyance plate 14*b* is displaced in the developer conveyance direction J1 illustrated in FIG. 3B.

Therefore, the conveyance of the developer is carried out in the following manner if the maximum accelerations a1 (max) and a2 (max) are set so as to satisfy {a1 (max)<a2 (max)} as indicated in the above-described expression 1. The developer conveyance plate 14*b* is provided with the maximum acceleration a1 (max) at which this developer conveyance plate 14*b* is displaced, by the vibration of the vibration providing member 13, in the developer conveyance direction J1 illustrated in FIG. 3B. Further, the developer conveyance plate 14*b* is provided with the maximum acceleration a2 (max) at which this developer conveyance plate 14*b* is displaced, by the vibration of the vibration providing member 13, in the developer conveyance opposite direction J2 illustrated in FIG. 3C.

Then, this developer conveyance plate 14*b* is repeatedly provided with the maximum acceleration a1 (max), at which the developer conveyance plate 14*b* is displaced in the developer conveyance direction J1 illustrated in FIG. 3B, and the maximum acceleration a2 (max), at which the developer conveyance plate 14*b* is displaced in the developer conveyance opposite direction J2 illustrated in FIG. 3C. This operation allows the developer (the toner) on the surface of the developer conveyance plate 14*b* to be displaced in the developer conveyance direction J1 illustrated in FIG. 3B.

<Acceleration Condition for Increasing Amount of Conveyance of Developer>

Consideration is to be made on the maximum acceleration a1 (max) at which this developer conveyance plate 14*b* is displaced, by the vibration of the vibration providing member 13, in the developer conveyance direction J1 illustrated in FIG. 3B. Further, consideration is to be made on the maximum acceleration a2 (max) at which the developer conveyance plate 14*b* is displaced in the developer conveyance opposite direction J2 illustrated in FIG. 3C. Then, the maximum acceleration a1 (max) and the maximum acceleration a2 (max) are in the following relationship with each other. The relationship between the maximum acceleration a1 (max) and the maximum acceleration a2 (max) may be expressed by the following expression, an expression 2, with use of the product {μ0×g} of the static friction coefficient μ0 between the surface of the developer conveyance plate 14*b* and the developer (the toner), and the gravitational acceleration g.

$$a1(\max)<\{\mu 0\times g\}<a2(\max) \quad \text{[Expression 2]}$$

If the maximum accelerations a1 (max) and a2 (max) are in the relationship expressed by the above-described expression 2, the maximum acceleration a1 (max) set to a lower acceleration than {μ0×g} is provided when the developer conveyance plate 14*b* is displaced by the vibration of the vibration providing member 13 in the developer conveyance direction J1 illustrated in FIG. 3B. This setting prohibits the developer (the toner) from being relatively displaced on the surface of the developer conveyance plate 14*b* in the developer conveyance opposite direction J2 illustrated in FIG. 3C.

Then, the maximum acceleration a2 (max) set to a higher acceleration than {μ0×g} is provided when the developer conveyance plate 14*b* is displaced in the developer conveyance opposite direction J2 illustrated in FIG. 3C. This setting causes the developer (the toner) to be relatively displaced on the surface of the developer conveyance plate 14*b* in the developer conveyance direction J1 illustrated in FIG. 3B.

In other words, the following result is acquired even when the developer conveyance plate 14*b* is displaced so as to follow the same track (displaced by the same distance) between a forward motion and a backward motion of a single reciprocation in the developer conveyance direction J1 illustrated in FIG. 3B and the developer conveyance opposite direction J2 illustrated in FIG. 3C. Consideration is to be made on the maximum acceleration a1 (max) at which this developer conveyance plate 14*b* is displaced, by the vibration of the vibration providing member 13, in the developer conveyance direction J1 illustrated in FIG. 3B. Further, consideration is to be made on the maximum acceleration a2 (max) at which the developer conveyance plate 14*b* is displaced in the developer conveyance opposite direction J2 illustrated in FIG. 3C. Then, the maximum acceleration a1 (max) and the maximum acceleration a2 (max) are set as indicated in the above-described expression 2.

This setting causes the developer conveyance plate 14*b* to be displaced in the developer conveyance direction J1 illustrated in FIG. 3B and the developer conveyance opposite direction J2 illustrated in FIG. 3C. During this single reciprocation, the developer (the toner) on the surface of this developer conveyance plate 14*b* can be conveyed by a larger amount (a longer distance) in the developer conveyance direction J1 illustrated in FIG. 3B.

<Acceleration Condition Incapable of Causing Conveyance of Developer>

On the other hand, consideration is to be made on the maximum acceleration a1 (max) at which this developer conveyance plate 14*b* is displaced, by the vibration of the vibration providing member 13, in the developer conveyance direction J1 illustrated in FIG. 3B. Further, consideration is to be made on the maximum acceleration a2 (max) at which the developer conveyance plate 14*b* is displaced in the developer conveyance opposite direction J2 illustrated in FIG. 3C. Then, the relationship between the maximum acceleration a1 (max) and the maximum acceleration a2 (max) may be expressed by the following expression, an expression 3, with use of the product {μ0×g} of the static friction coefficient μ0 between the surface of the developer conveyance plate 14*b* and the developer (the toner), and the gravitational acceleration g.

$$a1(\max)<a2(\max)<\{\mu 0\times g\} \quad \text{[Expression 3]}$$

If the maximum accelerations a1 (max) and a2 (max) are in the relationship expressed by the above-described expression 3, the developer (the toner) does not slide on the surface of the developer conveyance plate 14*b* by the vibration of the vibration providing member 13. Therefore, the developer (the toner) cannot be conveyed. In other words, the developer conveyance plate 14*b* is displaced, by the vibration of the vibration providing member 13, in the developer conveyance opposite direction J2 illustrated in FIG. 3C.

At this time, the developer (the toner) slides on the surface of this developer conveyance plate 14*b*. To allow the developer (the toner) to slide in this manner, the maximum acceleration a2 (max) at which this developer conveyance plate 14*b* is displaced, by the vibration of the vibration providing member 13, in the developer conveyance opposite direction J2 illustrated in FIG. 3C should be set as indicated in the following expression, an expression 4.

$$\{\mu 0 \times g\} < a2(\max) \quad \text{[Expression 4]}$$

The following static friction coefficient μ0 is established between the surface of the developer conveyance plate 14*b* and the developer (the toner). The surface of this developer conveyance plate 14*b* is being inclined at an inclination angle θ with respect to a horizontal plane with the developer (the toner) placed on the surface of this developer conveyance plate 14*b*. The static friction coefficient μ0 can be calculated by the following expression, an expression 5, with use of the inclination angle θ defined between the horizontal plane and the surface of the developer conveyance plate 14*b* when the developer (the toner) slides down on the surface of this developer conveyance plate 14*b* at this time.

$$\mu 0 = \tan \theta \quad \text{[Expression 5]}$$

At this time, the developer (the toner) on the surface of the developer conveyance plate 14*b* slides down from the surface of this developer conveyance plate 14*b* due to a slide generated at an interface between the surface of this developer conveyance plate 14*b* and the developer (the toner), and a slide generated at an interface between particles of the developer (the toner).

In other words, the following fact can be said with respect to the slide of the developer (the toner) relative to the surface of the developer conveyance plate 14*b* vibrated by the vibration providing member 13. This slide is not limited to the slide generated at the interface between the surface of this developer conveyance plate 14*b* and the developer (the toner). Besides that, this slide also includes the slide generated at the interface between the particles of the developer (the toner) above the surface of this developer conveyance plate 14*b*.

The developer (the toner) on the surface of the developer conveyance plate 14*b* is conveyed in the developer conveyance direction J1 illustrated in FIG. 3B by this developer conveyance plate 14*b* vibrated by the vibration providing member 13 according to the present exemplary embodiment. In the present exemplary embodiment, the vibration providing member 13 is driven at a frequency of 20 Hz. A displacement distance L1+L2 of the distal end 14*b*2 of the developer conveyance plate 14*b*, which is expressed by a difference between the maximum displacement position 14*b*2A and the maximum displacement position 14*b*2C of the distal end 14*b*2 of this developer conveyance plate 14*b* illustrated in FIGS. 3B and 3C, respectively, is set to approximately 3 mm.

<Function of Evening Out Developer in Longitudinal Direction of Developing Roller>

Next, a function of evening out the developer in the longitudinal direction of the developing roller 10*d* will be described with reference to FIG. 4. The developer conveyance plate 14*b* according to the present exemplary embodiment is also reciprocatingly vibrated by the vibration providing member 13 in the directions J3 and J4 perpendicular to the developer conveyance direction J1, which are illustrated in FIG. 4. The developer (the toner) on the developer conveyance plate 14*b* is subject to the following operation of vibrating the developer conveyance plate 14*b* and the following function of evening out the developer (the toner) in the longitudinal direction of the developing roller 10*d* illustrated in FIG. 2.

The developer conveyance plate 14*b* is vibrated by the vibration of the vibration providing member 13 in the directions J3 and J4 perpendicular to the developer conveyance direction J1, which are illustrated in FIG. 4. Other details are similar to the details at the time of the conveyance operation in the developer conveyance direction J1, which has been described above with reference to FIGS. 2 and 3B, and the conveyance operation in the developer conveyance opposite direction J2, which has been described above with reference to FIGS. 2 and 3C. Therefore, descriptions thereof will be omitted here to avoid redundancy.

The maximum acceleration a3 (max) in the direction J3 perpendicular to the developer conveyance direction J1, which is illustrated in FIG. 4, is provided to the developer conveyance plate 14*b* by the vibration of the vibration providing member 13. Further, the maximum acceleration a4 (max) in the direction J4, which is the opposite direction from this direction J3 perpendicular to the developer conveyance direction J1, is provided to the developer conveyance plate 14*b*.

The vibration providing member 13 according to the present exemplary embodiment is driven at the frequency of 20 Hz in the directions J3 and J4 perpendicular to the developer conveyance direction J1, which are illustrated in FIG. 4. Further, the developer conveyance plate 14*b* is displaced by a displacement distance L (an amplitude) of approximately 3 mm in the directions J3 and J4 perpendicular to the developer conveyance direction J1, which are illustrated in FIG. 4.

<Acceleration Condition Capable of Evening Out Developer>

The maximum acceleration a3 (max) to be provided from the vibration providing member 13 to the developer conveyance plate 14*b* in the direction J3 perpendicular to the developer conveyance direction J1, which is illustrated in FIG. 4, is set in the following manner. The maximum acceleration a3 (max) is set so as to substantially match the maximum acceleration a4 (max) to be provided from the vibration providing member 13 to the developer conveyance plate 14*b* in the direction J4.

Then, each of the maximum accelerations a3 (max) and a4 (max) is set to an acceleration that allows the developer (the toner) to slide on the developer conveyance plate 14*b*. Setting the maximum accelerations a3 (max) and a4 (max) in this manner allows the developer (the toner) on the developer conveyance plate 14*b* to be distributed while sliding in both of the directions J3 and J4 perpendicular to the developer conveyance direction J1, which are illustrated in FIG. 4, thereby being evened out in the longitudinal direction of the developing roller 10*d* (the left-right direction in FIG. 4).

A timing of the vibration operation of the vibration providing member 13 according to the present exemplary embodiment, and a timing of the operation of the developing roller 10*d*, which serves as the developer bearing member, are adjusted so as to be synchronized with each other. Further, the vibration providing member 13 performs the vibration operation in the following manner in each of the developer conveyance direction J1 and the developer conveyance opposite direction J2 illustrated in FIG. 4, and the directions J3 and J4 perpendicular to the developer conveyance direction J1, which are illustrated in FIG. 4.

After vibrating in the developer conveyance direction J1 and the developer conveyance opposite direction J2 illustrated in FIG. 4 for one second, the vibration providing member 13 vibrates in the directions J3 and J4 perpendicular to the developer conveyance direction J1, which are illustrated in FIG. 4, for one second. Further, the vibration providing member 13 repeatedly carries out these vibrations while alternately switching them.

In the present exemplary embodiment, 1:1 is set as a ratio between respective time periods of the vibration operation in the developer conveyance direction J1 and the developer conveyance opposite direction J2 illustrated in FIG. 4, and the vibration operation in the directions J3 and J4 perpendicular to the developer conveyance direction J1, which are illustrated in FIG. 4. The ratio between the time periods of these vibration operations can be arbitrarily set in consideration of an amount of the developer (the toner) to be supplied to the developing roller 10*d*, which serves as the developer bearing member, the necessity of evening out the developer (the toner) in the longitudinal direction of the developing roller 10*d*, or the like.

In the present exemplary embodiment, the maximum acceleration a1 (max), at which the developer conveyance plate 14*b* is vibrated by the vibration providing member 13 in the developer conveyance direction J1 illustrated in FIG. 3B, is set in the following manner. The maximum acceleration a1 (max) is set to a lower acceleration than the maximum acceleration a2 (max) in the developer conveyance opposite direction J2 illustrated in FIG. 3C. This setting allows the developer (the toner) on the developer conveyance plate 14*b* to be conveyed in the developer conveyance direction J1 illustrated in FIG. 3B.

Further, the accelerations a3 and a4 are provided in such a manner that the reciprocating motion therefrom becomes substantially symmetric, regarding the vibration in the directions J3 and J4 perpendicular to the developer conveyance direction J1, which are illustrated in FIG. 4. This setting allows the developer (the toner) on the developer conveyance plate 14*b* to be evened out in the directions J3 and J4 perpendicular to the developer conveyance direction J1, which are illustrated in FIG. 4, without being conveyed only in any specific direction. As a result, the developer (the toner) is prevented from being distributed by a larger amount in any one direction than in the other direction of the directions J3 and J4 perpendicular to the developer conveyance direction J1, which are illustrated in FIG. 4, within the developing container 14.

The material of the developer conveyance plate 14*b* does not necessarily have to be limited to the polystyrene. For example, polyethylene terephthalate (PET), polyethylene (PE), and polypropylene (PP) can be used as the material of the developer conveyance plate 14*b*.

Further, an acrylonitrile butadiene styrene copolymer (ABS) resin can be used as the material of the developer conveyance plate 14*b*. Further, a commonly-used plastic material, such as polycarbonate (PC) and polyacetal (polyoxymethylene (POM)), can be used as the material of the developer conveyance plate 14*b*.

The material of the flexible coupling member 14*d* does not necessarily have to be limited to the silicon rubber. For example, a commonly-used elastomer material, such as an acrylic rubber, a natural rubber, and a butyl rubber, can be used as the material of the coupling member 14*d*. Further, polypropylene (PP), polyethylene (PE), and a polyamide fiber, such as nylon (a trade name), can be used as the material of the coupling member 14*d*. Further, an aluminum foil, a film, paper, and the like can also be used as the material of the coupling member 14*d*.

According to the present exemplary embodiment, a dead space can be reduced inside the developer storage unit 14*t*, and the developer container 14 is thereby able to convey the developer (the toner) inside this developer storage unit 14*t* with an improved conveyance capability. More specifically, the horizontally extending developer conveyance plate 14*b*, which forms the bottom surface of the developer container 14, is vibrated by the vibration providing member 13 via the vibration target unit 14*b*1. By this vibration, the developer (the toner) in the developer storage unit 14*t* is conveyed toward the opening 19. This conveyance allows the developer (the toner) to be stably supplied to the developing roller 10*d*. Further, the dead space can be reduced in the path along which the developer is conveyed.

Further, the developer (the toner) can be distributed with less unevenness in the directions J3 and J4 perpendicular to the developer conveyance direction J1 illustrated in FIG. 4, which allows the developer (the toner) to be conveyed evenly in the longitudinal direction of the developing roller 10*d* serving as the developer bearing member.

Further, the present exemplary embodiment is also equipped with the function of evening out the developer (the toner) evenly in the longitudinal direction of the developing roller 10*d*. This function prevents the developer (the toner) from being distributed by a larger amount on any one side than the other side in the longitudinal direction of the developing roller 10*d* within the developer container 14. As a result, the developer container 14 can realize excellent conveyance of the developer (the toner) with a minimum volume.

FIGS. 5 to 8 relate to a second embodiment of the image forming apparatus on which the process cartridge including the developing apparatus equipped with the developer container according to one of the exemplary embodiments of the present invention is detachably mounted. Next, a configuration of this second exemplary embodiment will be described with reference to FIGS. 5 to 8. Components configured similarly to the above-described first exemplary embodiment will be identified by the same reference numerals or the same member names even if the reference numerals are different, and descriptions thereof will be omitted below.

In the above-described first exemplary embodiment, the developer conveyance plate 14*b*, on which the developer (the toner) in the developer container 14 is placed, is vibrated in the developer conveyance direction J1, the developer conveyance opposite direction J2, and the directions J3 and J4 perpendicular to the developer conveyance direction J1. The vibration providing member 13 operable in such a manner is constructed with use of the piezoelectric elements.

Figure 5:
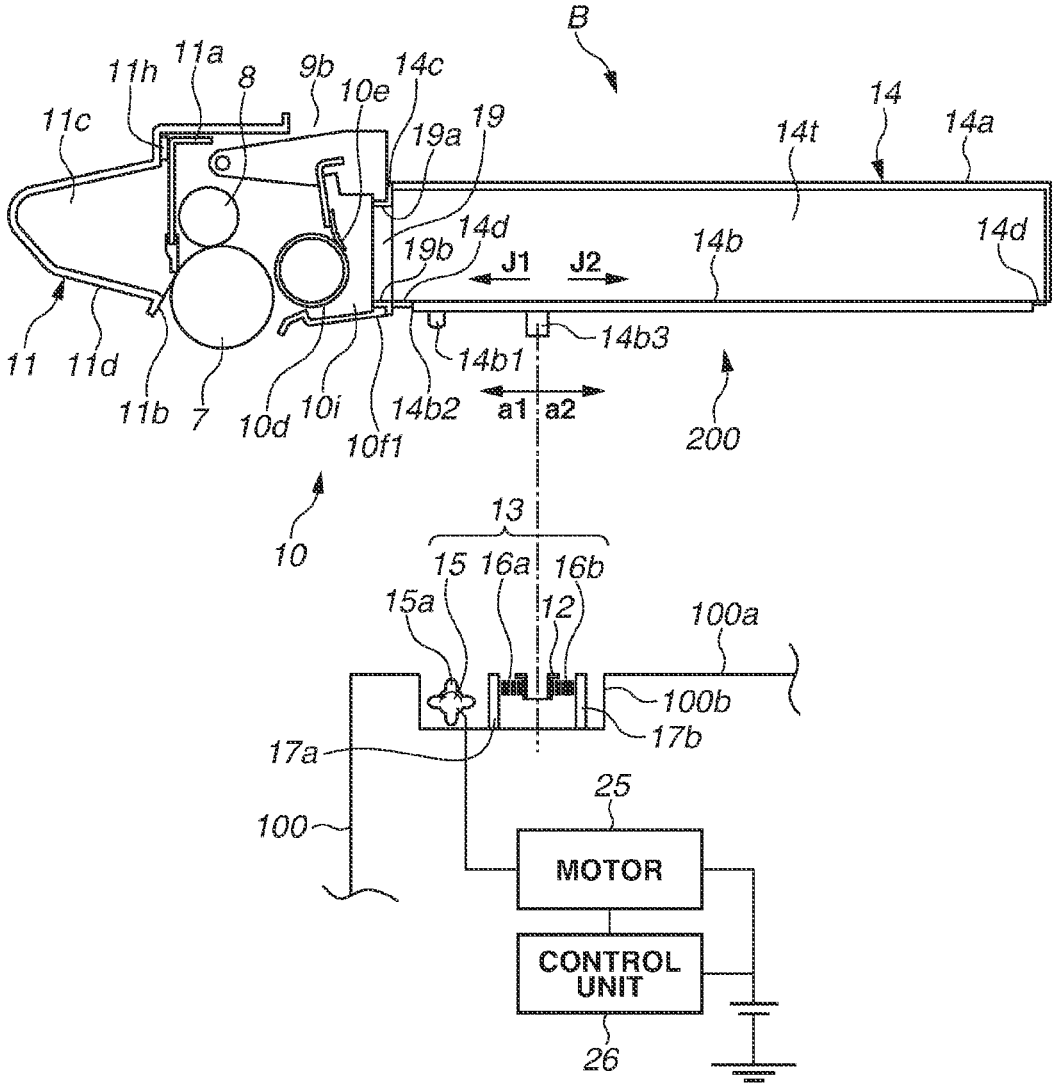
FIG. 5 is an illustrative cross-sectional view illustrating a configuration of a second exemplary embodiment of the process cartridge including the developing apparatus equipped with the developer container according to an exemplary embodiment of the present invention, and the image forming apparatus on which this process cartridge is to be mounted.

In the present exemplary embodiment, as illustrated in FIGS. 5 to 8, vibration target units 14*b*1 and 14*b*3 disposed under the lower surface of the developer conveyance plate 14*b* in a protruding manner are configured in the following manner. Further, the vibration providing member 13, which vibrates the developer conveyance plate 14*b* in the developer conveyance direction J1 illustrated in FIGS. 5 and 6B, is configured in the following manner. The vibration providing member 13 includes a cam member 15, which periodically pushes the vibration target unit 14*b*1 in the developer conveyance direction J1 illustrated in FIGS. 5 and 6B.

The cam member 15 according to the present exemplary embodiment includes a plurality of abutment portions 15*a* to 15*d*, which protrudes while being inclined at a predetermined inclination angle $\alpha$ or $\beta$ with respect to a rotational axis 15*e* as illustrated in FIGS. 7A to 7F. Then, the respective inclination angles $\alpha$ and $\beta$ of the abutment portions 15*a* and 15*b* located adjacently along a circumferential direction of this cam member 15 are inclined in opposite directions from each other with respect to the rotational axis 15*e*.

Further, the respective inclination angles β and α of the abutment portions 15*b* and 15*c* are inclined in opposite directions from each other with respect to the rotational axis 15*e*. Further, the respective inclination angles α and β of the abutment portions 15*c* and 15*d* are inclined in opposite directions from each other with respect to the rotational axis 15*e*. Further, the respective inclination angles β and α of the abutment portions 15*d* and 15*a* are inclined in opposite directions from each other with respect to the rotational axis 15*e*.

Figure 6A:
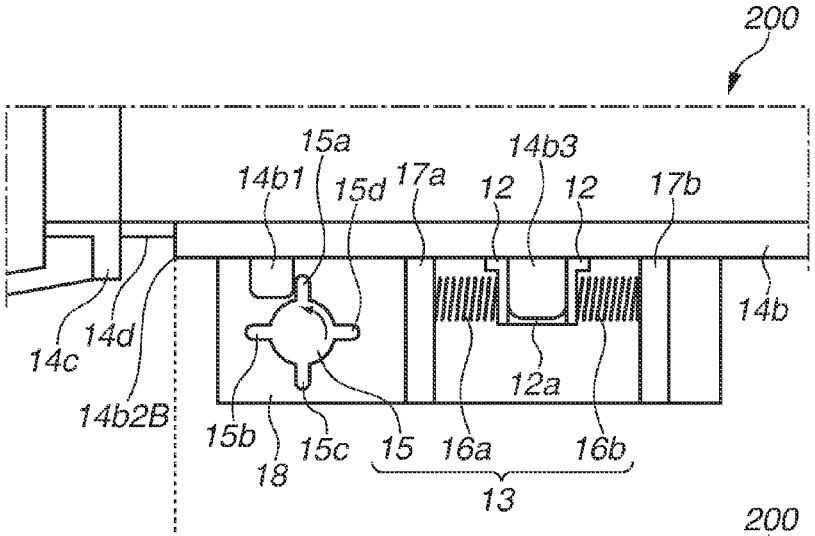
FIGS. 6A, 6B, and 6C are partial cross-sectional views illustrating how the conveyance member of the developer container according to the second exemplary embodiment is vibrated to thereby convey the developer.
Figure 6B:
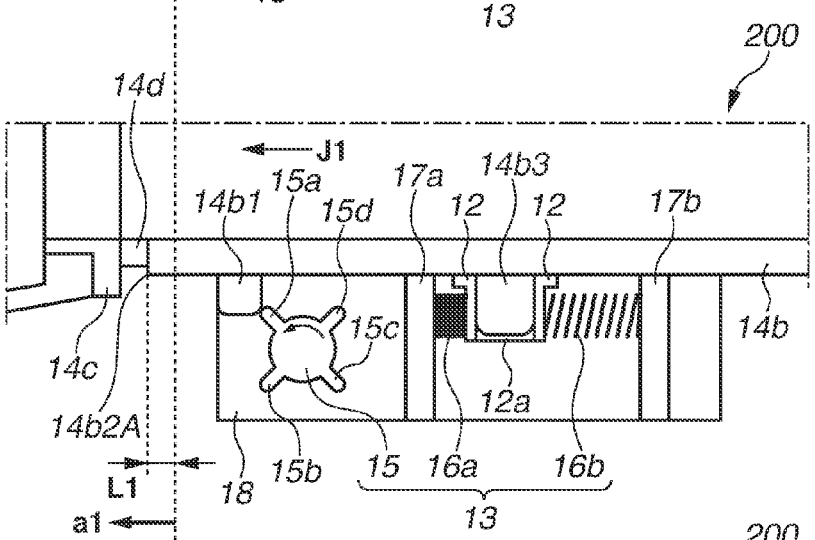
Figure 6C:
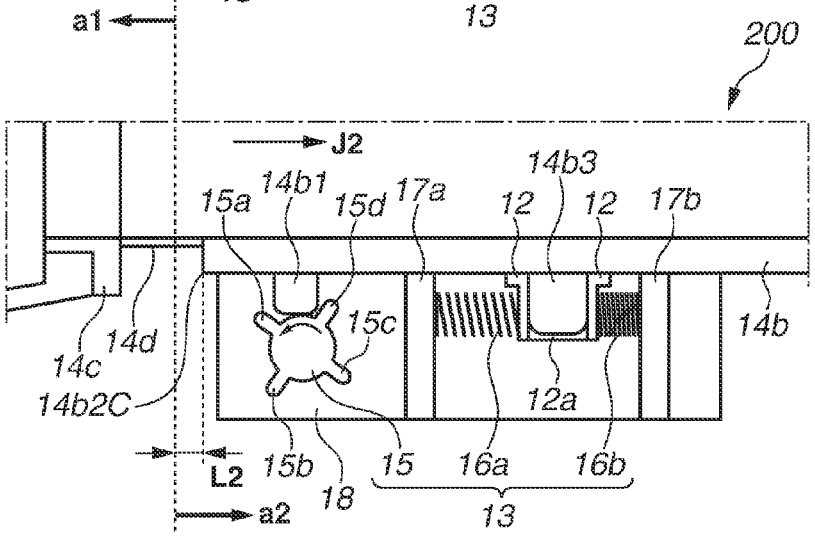

Further, the vibration providing member 13 includes biasing members 16*a* and 16*b*, which are made of coil springs that exert a biasing force in the developer conveyance opposite direction J2 illustrated in FIGS. 5 and 6C when the abutment portions 15*a* to 15*d* of the cam member 15 are separated from the vibration target unit 14*b*1. The developer conveyance opposite direction J2 illustrated in FIG. 6C is the opposite direction from the developer conveyance direction J1 illustrated in FIG. 6B.

In the present exemplary embodiment, a motor 25, which serves as a driving source, is driven and controlled by the controller (26,50) illustrated in FIG. 5, which serves as the control unit. Then, the cam member 15 illustrated in FIGS. 5 and 6A to 6C is rotationally driven by this motor. Then, each of the abutment portions 15*a* to 15*d* of this cam member 15 abuts against and pushes the vibration target unit 14*b*1, which is disposed under the lower surface of the developer conveyance plate 14*b* in the protruding manner, per predetermined cycle, as illustrated in FIGS. 6A to 6C. The abutment portions 15*a* to 15*d* of this cam member 15 protrude in four directions offset by 90 degrees for each of them in a radial direction of this cam member 15, respectively, while being inclined at the predetermined inclination angle α or β with respect to the rotational axis 15*e* of this cam member 15.

On the other hand, the vibration target unit 14*b*3, which is disposed under the lower surface of the developer conveyance plate 14*b* in the protruding manner, is subject to a stretching force and a tensile force (the biasing force) of the biasing members 16*a* and 16*b* disposed on both sides of this vibration target unit 14*b*3. Then, the vibration target unit 14*b*3 is biased in each of the developer conveyance direction J1 and the developer conveyance opposite direction J2 illustrated in FIG. 5.

The cam member 15 is rotated in a counterclockwise direction illustrated in FIGS. 5 and 6A to 6C. This rotation brings the abutment portions 15*a* to 15*d*, each of which protrudes while being inclined at the predetermined inclination angle α or β with respect to the rotational axis 15*e* of this cam member 15, into abutment with the vibration target unit 14*b*1 disposed under the lower surface of the developer conveyance plate 14*b* in the protruding manner. This abutment causes this vibration target unit 14*b*1 to be also displaced in the directions J3 and J4 perpendicular to the developer conveyance direction J1 along the abutment portions 15*a* to 15*d* inclined with respect to the rotational axis 15*e* of this cam member 15.

As a result, the developer conveyance plate 14*b* can be vibrated in the developer conveyance direction J1, the developer conveyance opposite direction J2, and the directions J3 and J4 perpendicular to the developer conveyance direction J1, which are illustrated in FIG. 4, via the vibration target units 14*b*1 and 14*b*3.

<Developer Conveyance Apparatus>

A configuration of the developer conveyance device 200 according to the present exemplary embodiment will be described with reference to FIGS. 5 to 8. As illustrated in FIGS. 5 and 6A to 6C, the vibration target units 14*b*1 and 14*b*3 are disposed in the protruding manner under the lower surface of the developer conveyance plate 14*b* disposed in the developer conveyance device 200 according to the present exemplary embodiment.

The vibration target unit 14*b*3 is fitted in the recessed portion 12*a* of the holder unit 12, which is disposed in a vibration device 18 provided on the main body side of the image forming apparatus 100 so as to be reciprocatable in the developer conveyance direction J1 and the developer conveyance opposite direction J2 illustrated in FIG. 5. One ends of the biasing members 16*a* and 16*b* made of the coil springs are engaged with the support units 17*a* and 17*b*, respectively, and the other ends of the biasing members 16*a* and 16*b* are engaged with the both side surfaces of this holder unit 12.

Due to this configuration, the biasing force constituted by the stretching force and the tensile force of the biasing members 16*a* and 16*b* is applied to the developer conveyance plate 14*b* in each of the developer conveyance direction J1 and the developer conveyance opposite direction J2 illustrated in FIG. 4 via the holder unit 12 and the vibration target unit 14*b*3.

The vibration device 18 includes the cam member 15, which is rotationally driven in the counterclockwise direction illustrated in FIGS. 5 and 6A to 6C by the motor serving as the driving source. The cam member 15 according to the present exemplary embodiment includes the abutment portions 15*a* to 15*d*, which protrude in the four directions radially offset by 90 degrees for each of them while being inclined at the predetermined inclination angle α or β with respect to the rotational axis 15*e* of this cam member 15 as illustrated in FIGS. 7A to 7F.

When the cam member 15 is rotationally driven in the counterclockwise direction illustrated in FIGS. 5 and 6A to 6C, each of the abutment portions 15*a* to 15*d* of this cam member 15 abuts against and pushes the vibration target unit 14*b*1, which is disposed under the lower surface of the developer conveyance plate 14*b* in the protruding manner, per predetermined cycle. At this time, this vibration target unit 14*b*1 is also displaced in the directions J3 and J4 perpendicular to the developer conveyance direction J1, which are illustrated in FIG. 4, along the abutment portions 15*a* to 15*d* inclined with respect to the rotational axis 15*e* of this cam member 15.

Figure 8A:
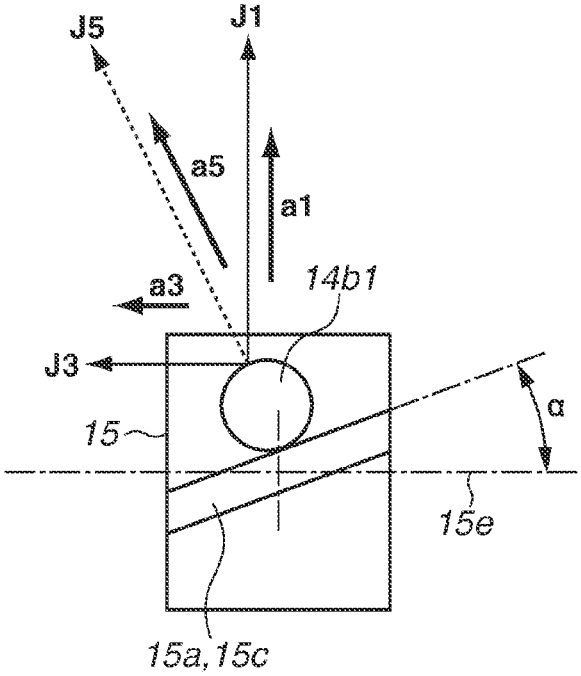
FIGS. 8A and 8B are illustrative plan views illustrating directions in which the conveyance member of the developer container is vibrated by the cam member constructing the vibration providing member that vibrates the conveyance member of the developer container according to the second exemplary embodiment.
Figure 8B:
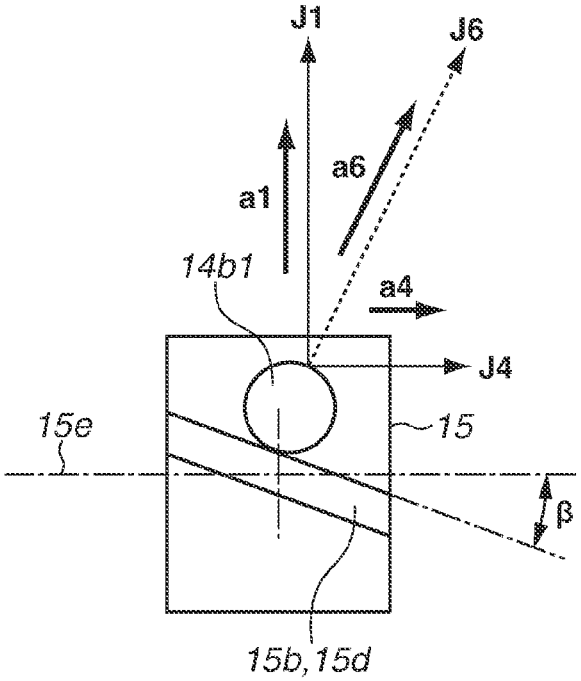

For example, as illustrated in FIG. 8A, when the abutment portion 15*a* or the abutment portion 15*c* of the cam member 15 is in abutment with the vibration target unit 14*b*1, the vibration target unit 14*b*1 is displaced in the developer conveyance direction J1 and the direction J3 perpendicular to this developer conveyance direction J1.

Further, as illustrated in FIG. 8B, when the abutment portion 15*b* or the abutment portion 15*d* of the cam member 15 is in abutment with the vibration target unit 14*b*1, the vibration target unit 14*b*1 is displaced in the developer conveyance direction J1 and the direction J4 perpendicular to this developer conveyance direction J1.

The vibration target unit 14*b*1, which protrudes under the lower surface of the developer conveyance plate 14*b*, is pushed by the abutment portion 15*a* or the abutment portion 15*c* of the cam member 15 rotationally driven in the counterclockwise direction illustrated in FIG. 6A. This push causes the developer conveyance plate 14*b* to be displaced in the developer conveyance direction J1 illustrated in FIG. 6B and the direction J3 perpendicular to this developer conveyance direction J1, which is illustrated in FIG. 8A, against the stretching force of the biasing member 16*a* and the tensile force of the biasing member 16*b*.

The vibration target unit 14*b*1, which protrudes under the lower surface of the developer conveyance plate 14*b*, is pushed by the abutment portions 15*b* or the abutment portion 15*d* of the cam member 15 rotationally driven in the counterclockwise direction illustrated in FIG. 6A. This push causes the developer conveyance plate 14*b* to be displaced in the developer conveyance direction J1 illustrated in FIG. 6B and the direction J4 perpendicular to this developer conveyance direction J1, which is illustrated in FIG. 8B, against the stretching force of the biasing member 16*a* and the tensile force of the biasing member 16*b*.

After that, as illustrated in FIG. 6C, the abutment portion 15*a*, 15*b*, 15*c*, or 15*d* pushing the vibration target unit 14*b*1 is disengaged from this vibration target unit 14*b*1. Then, the developer conveyance plate 14*b* is displaced in the following manner due to the stretching force of the biasing member 16*a* and the tensile force of the biasing member 16*b* via the holder unit 12 and the vibration target unit 14*b*3. The developer conveyance plate 14*b* is displaced in the developer conveyance opposite direction J2 illustrated in FIG. 6C and the direction J3 or J4 perpendicular to this developer conveyance opposite direction J2, which is illustrated in FIG. 8A or 8B.

The cam member 15 is continuously rotationally driven in the counterclockwise direction illustrated in FIG. 6A. This continuous rotation causes each of the abutment portions 15*a* to 15*d* of this cam member 15 to sequentially push the vibration target unit 14*b*1 protruding under the lower surface of the developer conveyance plate 14*b*. This is followed by repetition of the operation of disengaging the abutment portion 15*a*, 15*b*, 15*c*, or 15*d* from this vibration target unit 14*b*1.

As a result, the developer conveyance plate 14*b* is vibrated in the developer conveyance direction J1 and the developer conveyance opposite direction J2 illustrated in FIG. 5, and the directions J3 and J4 perpendicular to this developer conveyance direction J1, which are illustrated in FIGS. 8A and 8B. The vibration providing member 13 according to the present exemplary embodiment is constructed with use of the cam member 15, the biasing members 16*a* and 16*b*, and the like.

<Function of Conveying Developer>

Next, a function of conveying the developer by the developer conveyance device 200 according to the present exemplary embodiment will be described. In the present exemplary embodiment, the vibration device 18, which includes the cam member 15 and the biasing members 16*a* and 16*b* used to construct the vibration providing member 13, is disposed on the main body side of the image forming apparatus 100. Each of the abutment portions 15*a* to 15*d* of the cam member 15 rotating in the counterclockwise direction illustrated in FIGS. 5 and 6A to 6C sequentially abuts against and pushes the vibration target unit 14*b*1 protruding under the lower surface of the developer conveyance plate 14*b*.

Further, the abutment portions 15*a*, 15*b*, 15*c*, or 15*d* of the cam member 15 is disengaged from the vibration target unit 14*b*1. Then, the stretching force of the biasing member 16*a* and the tensile force of the biasing member 16*b* are each applied to the vibration target unit 14*b*3, which protrudes under the lower surface of the developer conveyance plate 14*b*, via the holder unit 12.

This operation allows the maximum accelerations a1 (max) and a2 (max) of the reciprocating motion to be provided in the developer conveyance direction J1 illustrated in FIG. 6B and the developer conveyance opposite direction J2 illustrated in FIG. 6C, respectively, to thereby vibrate the developer conveyance plate 14*b*. Further, the predetermined accelerations a3 and a4 corresponding to the above-described maximum accelerations a1 (max) and a2 (max) of the reciprocating motion are provided in the directions J3 and J4 perpendicular to this developer conveyance direction J1, which are illustrated in FIGS. 8A and 8B, respectively.

In the present exemplary embodiment, the maximum acceleration a1 (max) in the developer conveyance direction J1 illustrated in FIG. 6B, which is provided from the vibration target units 14*b*1 and 14*b*3 protruding under the lower surface of the developer conveyance plate 14*b* to this developer conveyance plate 14*b*, is also set in the following manner. The maximum acceleration a1 (max) is set to a lower acceleration than the maximum acceleration a2 (max) provided from these vibration target units 14*b*1 and 14*b*3 to this developer conveyance plate 14*b* in the developer conveyance opposite direction J2 illustrated in FIG. 6C, which is the opposite direction from the developer conveyance direction J1 illustrated in FIG. 6B.

In the present exemplary embodiment, the process cartridge B is mounted in the following manner according to an operation of attaching and detaching the process cartridge B to and from the main body of the image forming apparatus 100. The vibration target unit 14*b*1, which protrudes under the lower surface of the developer conveyance plate 14*b*, is detachably mounted at a position that allows the abutment portions 15*a* to 15*d* of the cam member 15 disposed on the main body side of the image forming apparatus 100 to abut against the vibration target unit 14*b*1. Further, the vibration target unit 14*b*3, which protrudes under the lower surface of the developer conveyance plate 14*b*, is detachably fitted into the recessed portion 12*a* of the holder unit 12 with the biasing members 16*a* and 16*b* coupled therewith.

The cam member 15 is rotated in the counterclockwise direction illustrated in FIGS. 5 and 6A to 6C by the motor 25 serving as the driving source mounted on the main body of the image forming apparatus 100. This rotation causes one of the abutment portions 15*a* to 15*d* of the cam member 15 to push the vibration target unit 14*b*1, which protrudes under the lower surface of the developer conveyance plate 14*b*, against the stretching force of the biasing member 16*a* and the tensile force of the biasing member 16*b*.

This push causes the distal end 14*b*2 of the developer conveyance plate 14*b*, which is illustrated in FIG. 5, to be displaced in the developer conveyance direction J1 from the initial position 14*b*2B illustrated in FIG. 6A to the maximum displacement position 14*b*2A illustrated in FIG. 6B. At this time, side ends of this developer conveyance plate 14*b* are also appropriately displaced in the direction J3 or J4 perpendicular to this developer conveyance direction J1, which is illustrated in FIG. 8A or 8B, according to the one of the abutment portions 15*a* to 15*d* of the cam member 15, which are illustrated in FIGS. 7A to 7F.

At this time, at least a part of the developer (the toner) on the surface of the developer conveyance plate 14*b* is displaced integrally with this developer conveyance plate 14*b* without sliding on the surface of this developer conveyance plate 14*b*. After that, as illustrated in FIG. 6C, the one of the abutment portions 15*a* to 15*d* of the cam member 15 is disengaged from the vibration target unit 14*b*1.

At this time, the maximum acceleration a2 (max) is provided to the vibration target unit 14*b*3, which protrudes under the lower surface of the developer conveyance plate 14*b*, in the developer conveyance opposite direction J2 illustrated in FIG. 6C via the holder unit 12 due to the stretching force of the biasing member 16*a* and the tensile force of the biasing member 16*b*. At this time, this developer conveyance plate 14*b* appropriately displaced in the direction J3 or J4 perpendicular to this developer conveyance direction J1, which is illustrated in FIG. 8A or 8B, is also displaced in the opposite direction from this direction J3 or J4.

This push causes the distal end 14*b*2 of the developer conveyance plate 14*b*, which is illustrated in FIG. 5, to be displaced in the developer conveyance opposite direction J2 from the maximum displacement position 14*b*2A illustrated in FIG. 6B to the maximum displacement position 14*b*2C illustrated in FIG. 6C. Further, the distal end 14*b*2 of the developer conveyance plate 14*b* is appropriately displaced in the direction J3 or J4 perpendicular to this developer conveyance direction J1, which is illustrated in FIG. 8A or 8B. At this time, the developer (the toner) on the surface of the developer conveyance plate 14*b* slides on the surface of this developer conveyance plate 14*b*. Further, the biasing members 16*a* and 16*b* also have a function as a damper.

More specifically, the vibration target unit 14*b*3, which protrudes under the lower surface of the developer conveyance plate 14*b*, receives a restorative force due to the elastic forces of the biasing members 16*a* and 16*b* via the holder unit 12. As this restorative force, the vibration target unit 14*b*3 alternately receives the biasing forces (the stretching forces and the tensile forces) in the developer conveyance direction J1 illustrated in FIG. 6B and the developer conveyance opposite direction J2 illustrated in FIG. 6C. Further, the vibration target unit 14*b*3 alternately receives the biasing forces (the stretching forces and the tensile forces) in the directions J3 and J4 perpendicular to this developer conveyance direction J1, which are illustrated in FIGS. 8A and 8B. Eventually, the vibration of the developer conveyance plate 14*b* diminishes, so that the distal end 14*b*2 of this developer conveyance plate 14*b* returns to the initial position 14*b*2B illustrated in FIG. 6A.

In the present exemplary embodiment, the cam member 15 is rotated in the counterclockwise direction illustrated in FIGS. 5 and 6A to 6C. This rotation causes the abutment portions 15*a* to 15*d* of this cam member 15 to apply, to the vibration target unit 14*b*1 protruding under the lower surface of the developer conveyance plate 14*b*, the force at a frequency of 20 Hz by abutting thereagainst the vibration target unit 14*b*1.

Further, consideration is to be made on the maximum displacement position 14*b*2A, to which the distal end 14*b*2 of the developer conveyance plate 14*b* is maximally displaced in the developer conveyance direction J1 as illustrated in FIG. 6B. Further, consideration is to be made on the initial position 14*b*2B of the distal end 14*b*2 of the developer conveyance plate 14*b*, which is illustrated in FIG. 6A. The displacement distance L1 of the distal end 14*b*2 of this developer conveyance plate 14*b*, which corresponds to a difference between the maximum displacement position 14*b*2A and the initial position 14*b*2B, is set to approximately 1.5 mm.

Further, consideration is to be made on the maximum displacement position 14*b*2C, to which the distal end 14*b*2 of the developer conveyance plate 14*b* is maximally displaced in the developer conveyance opposite direction J2 as illustrated in FIG. 6C. Further, consideration is to be made on the initial position 14*b*2B of the distal end 14*b*2 of the developer conveyance plate 14*b*, which is illustrated in FIG. 6A. The displacement distance L2 of the distal end 14*b*2 of this developer conveyance plate 14*b*, which corresponds to a difference between the maximum displacement position 14*b*2C and the initial position 14*b*2B, is set in the following manner.

The developer (the toner) remaining in the developer storage unit 14*t* and the developer conveyance plate 14*b* are displaced in the developer conveyance opposite direction J2. The displacement distance L2 is appropriately set so as to be a smaller value than the above-described displacement distance L1 illustrated in FIG. 6B according to inertia generated according to the weights of these remaining developer (the toner) and developer conveyance plate 14*b* and resistance received from the coupling member 14*d* and the biasing members 16*a* and 16*b* at this time.

Further, the vibration target unit 14*b*3 of the developer conveyance plate 14*b* receives a biasing force of approximately 1.96 N (200 gf)/mm from the biasing members 16*a* and 16*b* via the holder unit 12. Further, the toner supported by the developer conveyance plate 14*b* is approximately 100 g in weight.

The developer (the toner) on the surface of the developer conveyance plate 14*b* slides on the surface of this developer conveyance plate 14*b* under a similar condition to the above-described first exemplary embodiment, and therefore a description of this condition will be omitted here to avoid redundancy.

In the present exemplary embodiment, the vibration providing member 13 is constructed with use of the cam member 15 and the biasing members 16*a* and 16*b*. The developer conveyance plate 14*b* is vibrated by the vibration providing member 13 in the developer conveyance direction J1 illustrated in FIG. 6B. Further, the developer conveyance plate 14*b* is vibrated in the developer conveyance opposite direction J2 illustrated in FIG. 6C. Further, the developer conveyance plate 14*b* is vibrated in the directions J3 and J4 perpendicular to the developer conveyance direction J1, which are illustrated in FIGS. 8A and 8B. These vibrations are repeated. As a result, the developer (the toner) on the surface of the developer conveyance plate 14*b* is conveyed in the developer conveyance direction J1 illustrated in FIG. 6B. Further, the developer (the toner) is evened out in the directions J3 and J4 perpendicular to the developer conveyance direction J1, which are illustrated in FIGS. 8A and 8B.

<Function of Evening Out Developer Along Longitudinal Direction of Developer Bearing Member>

Figure 7C:
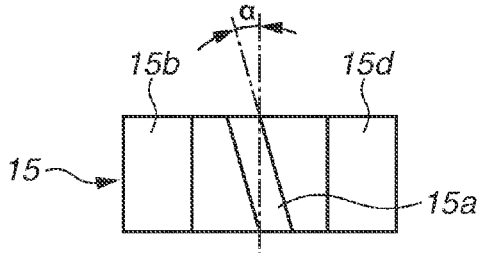
FIGS. 7B to 7E are side views illustrating abutment portions provided in a protruding manner in four directions on an outer peripheral surface of the cam member illustrated in FIG. 7A, as viewed from a direction perpendicular to the rotational axis.
Figure 7D:
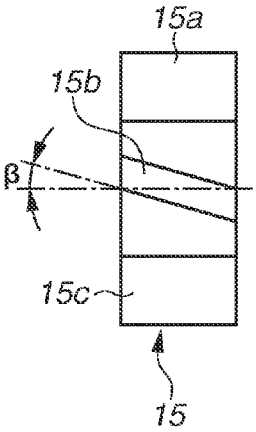
Figure 7A:
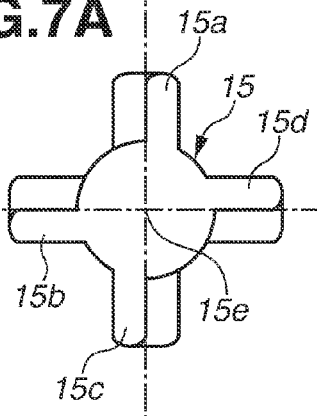
FIG. 7A is a front view illustrating a cam member constructing a vibration providing member that vibrates the conveyance member of the developer container according to the second exemplary embodiment, as viewed from a direction along a rotational axis.
Figure 7B:
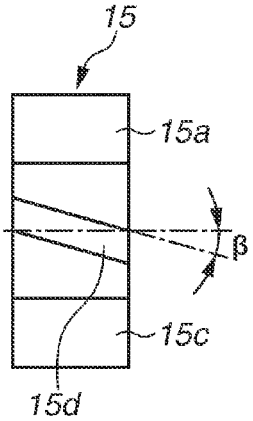
Figure 7E:
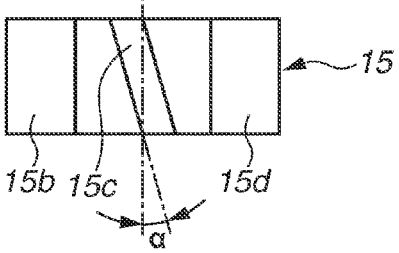
Figure 7F:
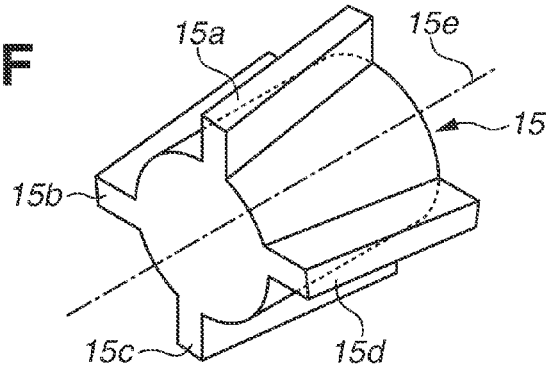
FIG. 7F is a perspective view illustrating a configuration of the cam member constructing the vibration providing member that vibrates the conveyance member of the developer container according to the second exemplary embodiment.

FIG. 7A is a front view of the cam member 15 as viewed from a direction along the rotational axis 15*e*. FIGS. 7B to 7E are respective side views of the abutment portions 15*a* to 15*d*, which are provided in the protruding manner in the four directions on the outer peripheral surface of the cam member 15 illustrated in FIG. 7A, as viewed from a direction perpendicular to the rotational axis 15*e*. FIG. 7F is a perspective view illustrating the configuration of the cam member 15. FIGS. 8A and 8B are illustrative side views of the cam member 15 as viewed from a direction perpendicular to the rotational axis 15*e* of this cam member 15.

As illustrated in FIGS. 7A to 7E, and 8A and 8B, the abutment portions 15*a* to 15*d* of the cam member 15 are provided while being inclined at the inclination angle $\alpha$ or $\beta$ with respect to the rotational axis 15*e* of this cam member 15. In the present exemplary embodiment, the inclination angles $\alpha$ and $\beta$ are set to 45 degrees by way of example.

The directions in which the abutment portions 15*a* to 15*d* of the cam member 15 are inclined with respect to the rotational axis 15*e* are arranged so as to be reversed alternately along the circumferential direction of this cam member 15. More specifically, the inclination angles $\alpha$ of the abutment portions 15*a* and 15*c* illustrated in FIGS. 7C, 7E, and 8A are inclined in the same direction. Further, the inclination angles β of the abutment portions 15*b* and 15*d* illustrated in FIGS. 7B, 7D, and 8B are inclined in the same direction.

Further, the abutment portions 15*a* and 15*b* located adjacently along the circumferential direction of the cam member 15 are arranged so as to be inclined in opposite directions from each other. Further, the abutment portions 15*b* and 15*c* located adjacently along the circumferential direction of this cam member 15 are arranged so as to be inclined in opposite directions from each other. Further, the abutment portions 15*c* and 15*d* located adjacently along the circumferential direction of this cam member 15 are arranged so as to be inclined in opposite directions from each other. Further, the abutment portions 15*d* and 15*a* located adjacently along the circumferential direction of this cam member 15 are arranged so as to be inclined in opposite directions from each other.

The cam member 15 is rotated in the counterclockwise direction illustrated in FIGS. 5 and 6A to 6C. This rotation causes each of the abutment portions 15*a* to 15*d* of this cam member 15 to sequentially abut against the vibration target unit 14*b*1 protruding under the lower surface of the developer conveyance plate 14*b*. A force applied thereby is exerted in the direction J3 perpendicular to the developer conveyance direction J1, which is illustrated in FIG. 8A. Further, this force is alternately applied in the direction J3, and the direction J4 perpendicular to the developer conveyance direction J1, which is illustrated in FIG. 8B.

As illustrated in FIG. 8A, the abutment portions 15*a* and 15*c* of the cam member 15 provide the accelerations a1 and a3 to the vibration target unit 14*b*1, which protrudes under the lower surface of the developer conveyance plate 14*b*, in the developer conveyance direction J1 and the direction J3 perpendicular to this developer conveyance direction J1, respectively.

Further, as illustrated in FIG. 8B, the abutment portions 15*b* and 15*d* of the cam member 15 provide the accelerations a1 and a4 to the vibration target unit 14*b*1 in the developer conveyance direction J1 and the direction J4 perpendicular to the developer conveyance direction J1, respectively.

As a result, each of the abutment portions 15*a* to 15*d* of the cam member 15 rotating in the counterclockwise direction illustrated in FIGS. 5 and 6A to 6C sequentially abuts against the vibration target unit 14*b*1 protruding under the lower surface of the developer conveyance plate 14*b*. The acceleration a5 is provided in the direction J5 that is the combination of the developer conveyance direction J1 and the direction J3, which is illustrated in FIG. 8A, each time the abutment portion 15*a* or 15*c* abuts against the vibration target unit 14*b*1.

Further, the acceleration a6 is provided in the direction J6 that is the combination of the developer conveyance direction J1 and the direction J4, which is illustrated in FIG. 8B. These accelerations a5 and a6 are alternately repeatedly provided. This operation causes the developer to be conveyed by the vibration transmitted from the vibration target unit 14*b*1 with use of the resultant force generated by adding the conveyance component in the developer conveyance direction J1 (the first direction) and the conveyance component in each of the directions J3 and J4 (the second direction) perpendicular to this developer conveyance direction J1.

In this manner, the accelerations a1, a3, and a4 are provided in the developer conveyance direction J1, and the directions J3 and J4 perpendicular to this developer conveyance direction J1 (the longitudinal direction of the developing roller 10*d*). As a result, the developer placed on the developer conveyance plate 14*b* can be evened out along the longitudinal direction of the developing roller 10*d*.

The developer placed on the developer conveyance plate 14*b* is conveyed along the longitudinal direction of the developing roller 10*d*, similarly to the above-described operation of conveying the developer in the developer conveyance direction J1. The developer is conveyed along the longitudinal direction of the developing roller 10*d* due to a difference between the maximum accelerations a (max) that the developer conveyance plate 14*b* receives from the cam member 15 and the biasing members 16*a* and 16*b*.

The operation of conveying the developer along the longitudinal direction of the developing roller 10*d* and the operation of conveying the developer in the developer conveyance direction J1 are different from each other in the following manner. The operation of conveying the developer along the longitudinal direction of the developing roller 10*d* is performed in the following manner. Each of the abutment portions 15*a* to 15*d* of the cam member 15 rotating in the counterclockwise direction illustrated in FIGS. 5 and 6A to 6C sequentially abuts against the vibration target unit 14*b*1 protruding under the lower surface of the developer conveyance plate 14*b*. At this time, the accelerations a in different directions are alternately provided to this developer conveyance plate 14*b*.

As illustrated in FIG. 8A, the abutment portions 15*a* and 15*c* of the cam member 15 convey the developer (the toner) on the developer conveyance plate 14*b* in the developer conveyance direction J1 and the direction J3 perpendicular to this developer conveyance direction J1.

As illustrated in FIG. 8B, the abutment portions 15*b* and 15*d* of the cam member 15 convey the developer (the toner) on the developer conveyance plate 14*b* in the developer conveyance direction J1 and the direction J4 perpendicular to this developer conveyance direction J1.

As a result, the developer (the toner) on the developer conveyance plate 14*b* can be evened out evenly along both orientations of the longitudinal direction of the developing roller 10*d* without being conveyed only in any specific orientation along the longitudinal direction of the developing roller 10*d*. This effect prevents the developer (the toner) on the developer conveyance plate 14*b* from being distributed by a larger amount in any specific orientation than in the other orientation along the longitudinal direction of the developing roller 10*d*. Other features are configured similarly to the above-described first exemplary embodiment, whereby the present exemplary embodiment can bring about similar effects.

Each of the above-described exemplary embodiments has been described as one example in which the vibration providing member 13 constructed with use of the piezoelectric elements, or the vibration providing member constructed with use of the cam member 15 and the biasing members 16*a* and 16*b* is disposed on the main body side of the image forming apparatus 100. Besides this example, these vibration providing members 13 can be disposed on the process cartridge B side or the developer container 14 side. As a result, the configuration can be simplified because of elimination of the necessity of connecting the main body of the image forming apparatus 100 and the process cartridge B via an interface or the like to drive the vibration providing member 13.

Further, the vibration providing member 13 does not necessarily have to be limited to the piezoelectric elements, or the cam member 15 and the biasing members 16*a* and 16*b*, and may be constructed with use of any of various kinds of vibration means that can realize similar functions and effects.

Further, each of the above-described exemplary embodiments has been described as one example in the case where the developer conveyance plate 14*b* forming the bottom surface of the developer container 14 is substantially horizontally arranged when the process cartridge B is mounted on the main body of the image forming apparatus 100. Besides this example, the present invention can also be applied even in a case where the developer conveyance plate 14*b* forming the bottom surface of the developer container 14 is inclined at a predetermined angle with respect to the horizontal plane when the process cartridge B is mounted on the main body of the image forming apparatus 100.

According to an experiment conducted by the present inventors, an excellent result was able to be acquired even when the developer conveyance plate 14*b* described in the above-described second exemplary embodiment was set at the following inclination angle. Even when the developer conveyance plate 14*b* was arranged at a rising angle of 10 degrees with respect to the horizontal plane in the developer conveyance direction J1 illustrated in FIG. 5, the developer (the toner) on the surface of this developer conveyance plate 14*b* was able to be conveyed in the developer conveyance direction J1 illustrated in FIG. 5.

Further, each of the above-described exemplary embodiments has been described as one example in the case where the frame member 14*a* and the opening member 14*c* of the developer container 14 are prepared as different members from each other. Besides this example, the frame member 14*a* and the opening member 14*c* can also be configured integrally with each other. Further, the developing frame member 10*f*1 of the developing unit 10 and the opening member 14*c* can also be configured integrally with each other. Further, the developing frame member 10*f*1 of the developing unit 10, the opening member 14*c*, and the frame member 14*a* of the developer container 14 can also be configured integrally with one another.

Further, each of the above-described exemplary embodiments has been described as one example in the case where the frame member 14*a* and the coupling member 14*d* of the developer container 14 are prepared as different members from each other. Besides this example, the frame member 14*a* and the coupling member 14*d* of the developer container 14 can also be configured integrally with each other with use of a flexible member, such as polypropylene, polyethylene, a polyamide synthetic fiber such as nylon (registered trademark), an aluminum foil, a film, paper, and elastomer.

Further, the image forming apparatus 100 illustrated in FIG. 1 has been described as one example in which the image forming apparatus 100 is configured to allow the monochrome process cartridge B to be detachably mounted thereon and is configured to form a monochrome image. Besides this example, a plurality of developing units 10 (developing apparatuses), which serves as developing units for individual colors, can be provided. The image forming apparatus 100 can also be configured in the following manner. The process cartridges B that form an image with a plurality of colors (for example, a two-color image, a three-color image, a full-color image, or the like) are detachably mounted on the image forming apparatus 100. Then, the developer conveyance plate 14*b*, which forms the bottom surface of the developer container 14 of each of the process cartridges B, is vibrated with use of the vibration providing member 13 according to the above-described first or second exemplary embodiment, by which the developer (the toner) is conveyed.

Further, each of the above-described exemplary embodiments has been described as one example in the case where the unused developer (toner) stored in the developer storage unit 14*t* is conveyed. Besides this example, the present invention can also be applied to conveyance of the used toner (the residual toner after the transfer) collected in the removed toner storage unit 11*c* (in the cleaning unit), and conveyance of the toner at the developing unit 10 (the developing apparatus) or the like other than the process cartridge B.

Further, in each of the above-described exemplary embodiments, the vibration providing member 13 vibrates at a frequency of 5 Hz to 100 Hz. Further, regarding the inclination angle of the developer conveyance plate 14*b*, the developer (the toner) on the surface of the developer conveyance plate 14*b* can also be conveyed toward the opening 19 even in a case where the developer conveyance plate 14*b* is inclined at a rising angle smaller than 10 degrees with respect to the horizontal plane in the developer conveyance direction J1 illustrated in FIGS. 2 and 5.

Further, the developer (the toner) on the surface of the developer conveyance plate 14*b* can also be conveyed toward the opening 19 even in a case where the developer conveyance plate 14*b* is inclined at a descending angle of 60 degrees or smaller with respect to the horizontal plane in the developer conveyance direction J1 illustrated in FIGS. 2 and 5.

Further, in each of the above-described exemplary embodiments, the developer conveyance plate 14*b* is not made of an elastic member. However, the developer conveyance plate 14*b* can also be made of an elastic member capable of conveying the developer (the toner) and maintaining the substantially plate-like shape.

Further, in each of the above-described exemplary embodiments, the vibration providing member 13 constructed with use of the piezoelectric elements is disposed on the main body of the image forming apparatus 100. Alternatively, the vibration device 18 including the vibration providing member 13 constructed with use of the cam member 15 and the biasing members 16*a* and 16*b* is disposed on the main body of the image forming apparatus 100. Besides this example, the vibration providing member 13 constructed with use of the piezoelectric elements, or the vibration device 18 including the vibration providing member 13 constructed with use of the cam member 15 and the biasing members 16*a* and 16*b* can be is disposed on the developer container 14.

In this case, the abutment portion 15*a* of the cam member 15 also periodically pushes the vibration target unit 14*b*1, which is disposed in the protruding manner below the developer conveyance plate 14*b* serving as the conveyance member, in the developer conveyance direction J1 (the first direction). The biasing members 16*a* and 16*b* exert the biasing force in the developer conveyance opposite direction J2, which is the opposite direction from the developer conveyance direction J1, when the abutment portion 15*a* of the cam member 15 is separated from the vibration target unit 14*b*1.

In this case, the developer container 14 should have an electric contact that receives the voltages or the like for driving the piezoelectric elements from the main body of the image forming apparatus 100. Alternatively, the developer container 14 should have an electric contact that receives the voltage or the like for driving the motor for rotating the cam member 15 from the main body of the image forming apparatus 100. Similarly, the main body of the image forming apparatus 100 should also have an electric contact for electrically connecting to the electric contact provided to the developer container 14.

Figure 9:
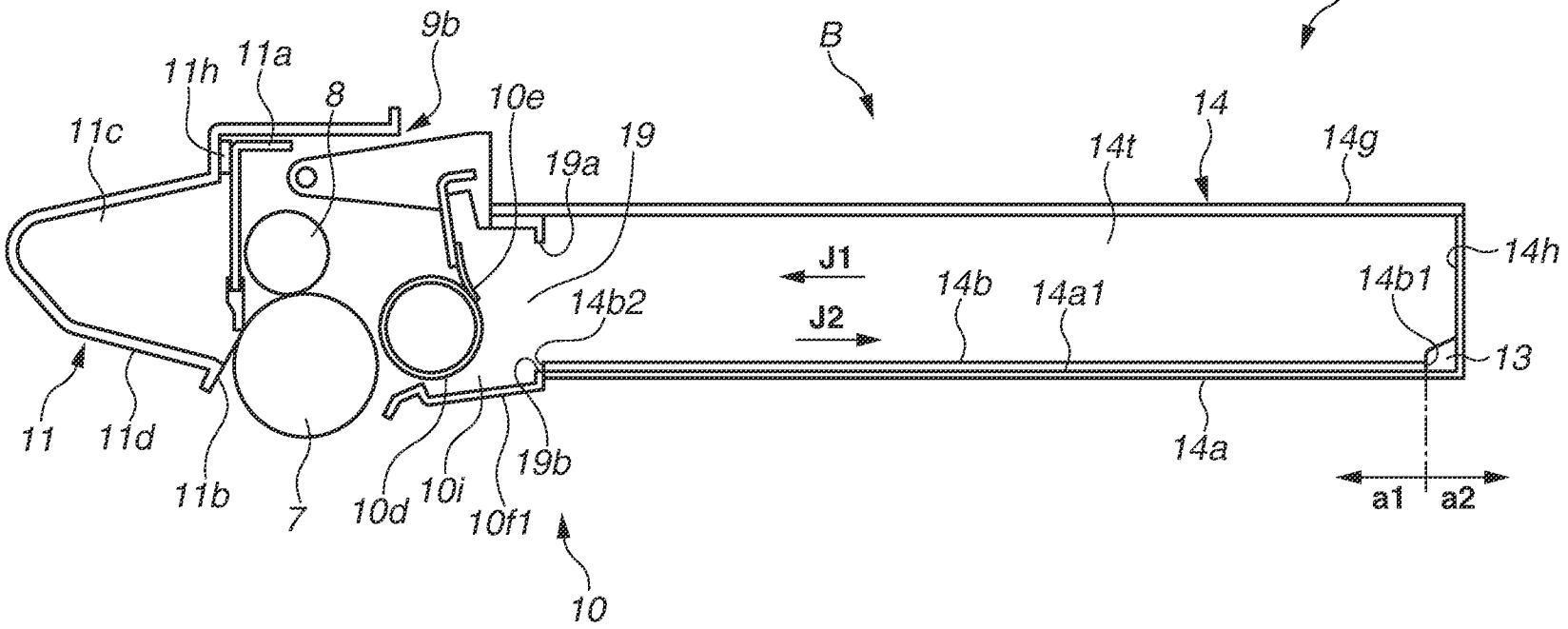
FIG. 9 is an illustrative cross-sectional view illustrating a configuration of a third exemplary embodiment of the process cartridge including the developing apparatus equipped with the developer container according to an exemplary embodiment of the present invention.

FIG. 9 relates to a third exemplary embodiment of the image forming apparatus on which the process cartridge including the developing apparatus equipped with the developer container according to one of the exemplary embodiments of the present invention is detachable mounted. Next, a configuration of this third exemplary embodiment will be described with reference to FIG. 9. Components configured similarly to any of the above-described exemplary embodiments will be identified by the same reference numerals or the same member names even if the reference numerals are different, and descriptions thereof will be omitted below.

<Developer Container>

The developer container 14 according to the present exemplary embodiment includes the frame member 14*a* and a cover member 14*g*, as illustrated in FIG. 9. When the cover member 14*g* is attached to the frame member 14*a*, the opening 19 is formed. Further, the developer container 14 is set in such a manner that a floor surface 14*a*1 of the frame member 14*a* is oriented substantially horizontally when the process cartridge B is mounted on the main body of the image forming apparatus 100. The developer (the toner) inside the developer container 14 is supplied to the developing roller 10*d* via the opening 19.

<Conveyance Member>

Next, a configuration of the developer conveyance plate 14*b*, which serves as the conveyance member in the present exemplary embodiment, will be described. The developer conveyance plate 14*b*, which serves as the conveyance member in the present exemplary embodiment, is a plate-shaped member disposed below the developer and used to convey the developer. The developer conveyance plate 14*b* is supported on the floor surface 14*a*1 of the developer container 14 reciprocatably in the developer conveyance direction J1 and the developer conveyance opposite direction J2. The vibration target unit 14*b*1 is provided at an end (a right end in FIG. 9) of a longitudinal direction (a left-right direction in FIG. 9) of the developer conveyance plate 14*b*.

In the developer conveyance plate 14*b* serving as the conveyance member, the distal end 14*b*2 thereof in the developer conveyance direction J1 is configured as a free end unfixed to the floor surface 14*a*1. Further, a base end thereof in the developer conveyance direction J1 is the vibration target unit 14*b*1. The vibration target unit 14*b*1 of the developer conveyance plate 14*b* is configured as a fixed end fixed to the vibration providing member 13, which transmits the vibration to this developer conveyance plate 14*b*.

The vibration target unit 14*b*1 of the developer conveyance plate 14*b* according to the present exemplary embodiment is fixed to one end of the vibration providing member 13 constructed with use of piezoelectric elements. The other end of the vibration providing member 13 is fixed to a back end 14*h* of the developer container 14 opposite from the opening 19.

A not-illustrated direct-current power source is electrically connected to electrodes disposed on both ends of the vibration providing member 13 constructed with use of the piezoelectric elements. Then, similarly to the above-described first exemplary embodiment, the not-illustrated direct-current power source is controlled by the controller 50 illustrated in FIG. 1, which serves as the control unit, thereby turning on/off a direct-current voltage to be applied to the electrodes disposed on the both ends of the vibration providing member 13 at a predetermined timing.

For example, a slowly increasing direct-current voltage is applied from the not-illustrated direct-current power source to the electrodes disposed on the both ends of the vibration providing member 13. This application allows the acceleration a1, at which the developer conveyance plate 14*b* is displaced in the developer conveyance direction J1 (the forward path), to be provided as a low acceleration. Further, the direct-current voltage applied to the electrodes disposed on the both ends of this vibration providing member 13 is suddenly dropped. This adjustment allows the acceleration a2, at which the developer conveyance plate 14*b* is displaced in the developer conveyance opposite direction J2 (the backward path), to be provided as a high acceleration.

The developer conveyance device 200 according to the present exemplary embodiment provides the configuration that is different from the configuration that directly vibrates or swings the developer container 14. More specifically, the developer conveyance device 200 according to the present exemplary embodiment is configured to reciprocatingly vibrate the developer conveyance plate 14*b* placed on the floor surface 14*a*1 of the developer container 14, which serves as the conveyance member, in the developer conveyance direction J1 and the developer conveyance opposite direction J2.

The reason therefor is as follows. The configuration that vibrates or swings the developer container 14 requires a mechanism for vibrating or swinging this developer container 14 outside the developer container 14, and thus requires a space therefor. The present exemplary embodiment does not require the provision of such a mechanism, and thus does not require a wasteful space. Further, directly vibrating or swinging the developer container 14 leads to an error or the like in positional precision of the developing roller 10*d* coupled to the developer container 14, thereby negatively affecting image formation. On the other hand, the present exemplary embodiment can prevent this problem.

In the present exemplary embodiment, the disposed vibration providing member 13 is also constructed with use of the first piezoelectric element that vibrates in the developer conveyance direction J1 and the developer conveyance opposite direction J2 illustrated in FIG. 9. Further, the disposed vibration providing member 13 is also constructed with use of the not-illustrated second piezoelectric element that vibrates the developer conveyance plate 14*b* in the directions perpendicular to the developer conveyance direction J1 illustrated in FIG. 9. Other features are configured similarly to any of the above-described exemplary embodiments, whereby the present exemplary embodiment can bring about similar effects.

According to the present invention, the dead space can be reduced in the path along which the developer is conveyed, and the developer can be distributed with less unevenness in the directions perpendicular to the developer conveyance direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-065552, filed Mar. 27, 2015, which is hereby incorporated by reference herein in its entirety.

What is claimed is:

1. A developer container including an opening and configured to store developer therein, the developer container comprising a conveyance member configured to convey the developer, wherein the conveyance member includes a vibration target unit configured to receive a vibration, wherein the conveyance member conveys the developer in a first direction in which the developer is conveyed toward an opening side, and in a second direction perpendicular to the first direction, along a surface of the conveyance member for carrying the developer, wherein the conveyance member conveys the developer by the vibration transmitted from the vibration target unit with a resultant force generated by a conveyance component in the first direction and a conveyance component in the second direction, and wherein a maximum acceleration in the first direction that is provided to the conveyance member by the vibration transmitted from the vibration target unit is set to a lower acceleration than a maximum acceleration in an opposite direction from the first direction that is provided by the vibration transmitted from the vibration target unit.

2. The developer container according to claim 1, wherein a storage unit where the developer is stored is formed by the conveyance member, an opening member including the opening, a coupling member coupling the opening member and the conveyance member with each other, and a frame member.

3. The developer container according to claim 2, wherein the coupling member is flexible.

4. The developer container according to claim 1, wherein the vibration target unit is located under the conveyance member.

5. The developer container according to claim 1, wherein the conveyance member is disposed on a lower end side where a lower end of the opening is located.

6. The developer container according to claim 1, wherein an acceleration in the second direction that is provided from the vibration target unit to the conveyance member is set to even out the developer on the conveyance member along the second direction.

7. The developer container according to claim 1, further comprising a vibration providing member configured to vibrate the vibration target unit, wherein the vibration providing member includes a piezoelectric element.

8. The developer container according to claim 1, further comprising a vibration providing member configured to vibrate the vibration target unit, wherein the vibration providing member includes a cam member configured to periodically push the vibration target unit in the first direction, and a biasing member configured to exert a biasing force in the opposite direction from the first direction when the cam member is separated from the vibration target unit.

9. The developer container according to claim 8, wherein the cam member includes a plurality of abutment portions each protruding while being inclined at a predetermined inclination angle with respect to a rotational axis, and wherein inclination angles of the abutment portions located adjacently along a circumferential direction of the cam member are inclined in opposite directions from each other with respect to the rotational axis.

10. A developing apparatus comprising:

the developer container according to claim 1; and a developer bearing member configured to bear the developer conveyed by the conveyance member.

11. The developing apparatus according to claim 10, wherein the conveyance member, the opening, a coupling member coupling an opening member including the opening and the conveyance member with each other, and the developer bearing member are arranged in this order from an upstream side to a downstream side in the first direction.

12. A process cartridge comprising the developer container according to claim 1.

13. An image forming apparatus comprising the developer container according to claim 1, wherein the image forming apparatus forms an image with use of the developer.

14. An image forming apparatus comprising:

the developer container according to claim 1; and a vibration providing member configured to vibrate the vibration target unit, wherein the image forming apparatus forms an image with use of the developer.

* * * * *